US009747763B1

(12) United States Patent
Scordato et al.

(10) Patent No.: US 9,747,763 B1
(45) Date of Patent: Aug. 29, 2017

(54) NETWORKED AUDIBLE AND VISUAL ALARM APPARATUS AND METHOD OF SYNCHRONIZED ALERTING

(71) Applicant: Athena Patent Development LLC, Lancaster, NY (US)

(72) Inventors: Stephen Scordato, Lockport, NY (US); John A. Carlin, Buffalo, NY (US); Michael Arno, Clarence, NY (US); Kevin A. Grupp, Clarence, NY (US)

( * ) Notice: Subject to any disclaimer, the term of this patent is extended or adjusted under 35 U.S.C. 154(b) by 0 days.

(21) Appl. No.: 15/408,597

(22) Filed: Jan. 18, 2017

Related U.S. Application Data

(60) Provisional application No. 62/361,775, filed on Jul. 13, 2016.

(51) Int. Cl.

| | |
|---|---|
| ***G08B 17/10*** | (2006.01) |
| ***G08B 7/06*** | (2006.01) |
| ***G08B 21/14*** | (2006.01) |
| ***G08B 21/16*** | (2006.01) |

(52) U.S. Cl.
CPC ..... *G08B 7/06* (2013.01); *G08B 17/10* (2013.01); *G08B 21/14* (2013.01); *G08B 21/16* (2013.01)

(58) Field of Classification Search
CPC ..... G08B 7/06; G08B 17/117; G08B 19/00; F21V 33/0076; H04M 1/22
USPC ..... 340/428, 632, 815.45; 362/86
See application file for complete search history.

(56) References Cited

U.S. PATENT DOCUMENTS

| | | | | |
|---|---|---|---|---|
| 7,476,002 | B2 * | 1/2009 | Wolf | A01M 1/2083 362/231 |
| 7,786,879 | B2 * | 8/2010 | Lax | G08B 17/10 340/500 |
| 8,042,961 | B2 * | 10/2011 | Massara | F21V 23/0471 362/249.02 |
| 8,770,771 | B2 * | 7/2014 | Preta | B60Q 1/0023 340/438 |
| 9,408,282 | B1 * | 8/2016 | Springer | H05B 37/0272 |
| 2010/0103664 | A1 * | 4/2010 | Simon | F21V 33/0052 362/234 |
| 2011/0145746 | A1 | 6/2011 | Malnati et al. | |
| 2015/0187194 | A1 | 7/2015 | Hypolite et al. | |
| 2015/0259078 | A1 * | 9/2015 | Filipovic | H04W 88/08 244/114 R |

(Continued)

*Primary Examiner* — Toan N Pham
(74) *Attorney, Agent, or Firm* — Vincent G. LoTempio; Kloss, Stenger & LoTempio; David T. Stephenson

(57) ABSTRACT

A networked visual and audible alarm apparatus and method of synchronized alerting provides audible and visual alerts upon detection of events, such as smoke, carbon monoxide and gas. The apparatus adapts to a light bulb socket to provide normal lighting when no event is detected. The apparatuses are systematically disposed through different sections of a structure. Each apparatus independently emits an audible signal, dependent on the type of event detected in the respective section for the apparatus. Further, each alarm apparatus provides a colored high strobe light that illuminates at a color and intensity that varies, dependent on the type of event detected in the section of the alarm apparatus. A microphone enables the alarm apparatus to initiate the audible signal and the high strobe light upon detecting an audible signal from an adjacent alarm apparatus. Also, voice commands can be used to power off the alarming apparatus.

20 Claims, 14 Drawing Sheets

(56) References Cited

U.S. PATENT DOCUMENTS

2015/0373307 A1* 12/2015 Huang ..... H04N 7/183
348/155
2016/0284176 A1* 9/2016 Harrington ..... G08B 7/06

* cited by examiner

NETWORKED AUDIBLE AND VISUAL ALARM APPARATUS AND METHOD OF SYNCHRONIZED ALERTING

CROSS REFERENCE OF RELATED APPLICATIONS

This application claims the benefits of U.S. provisional application No. 62/361,775, filed Jul. 13, 2016 and entitled LED LIGHT BULB WITH ALARMING APPARATUS FOR SMOKE, CARBON MONOXIDE, & GAS AND METHOD THEREFORE which provisional application is incorporated by reference herein in its entirety.

FIELD OF THE INVENTION

The present invention relates generally to a networked visual and audible alarm apparatus and method of synchronized alerting. More so, the present invention relates to an alarm apparatus that provides a plurality of alarm apparatuses configured to audibly and visually alert to at least one event, such as smoke, carbon monoxide, and general gases; whereby the alarm apparatuses are systematically disposed through different sections of a structure; whereby each alarm apparatus independently emits an audible signal, dependent on the type of event detected in the respective section for the alarm apparatus; whereby each alarm apparatus illuminates a high strobe light at a variable color and intensity, dependent on the type of event detected in the respective section of the alarm apparatus; whereby the alarm apparatuses comprises a microphone for communicating with adjacent alarm apparatuses, so as to initiate the audible signal and the high strobe light upon detecting an audible signal from an adjacent alarm apparatus; whereby each alarm apparatus emits an independent audible signal and high strobe light, dependent on the type of event in the specific section of the alarm apparatus; whereby the alarm apparatuses comprise a voice activated control portion for enabling a user to power off the alarm apparatus when in alarm mode.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Generally, smoke detectors that detect the products of combustion and sound an alarm when a concentration threshold is exceeded are coming into widespread use. Since most are powered by batteries or house current and permanently placed in rooms, recreational vehicles and the like, each room to be fully protected must include a separate detector. When the alarm sounds, the person immediately evacuates the building. The use of smoke detectors as well as carbon monoxide detectors have become much more common and widespread than in the past.

Smoke and carbon monoxide alarming devices, manufactured in their most common configuration for homes, etc., provide a level of self-assurance and are a must to have in any home for safety; while a slightly more sophisticated configuration can be found in every office, institution and industry setting. It is known that many jurisdictions require smoke detectors be strategically placed within both residential and commercial buildings at the time of construction or during remodeling recognizing that such devices can and oftentimes do save lives. Similarly, carbon monoxide detectors have become more widespread recognizing that carbon monoxide, although deadly, is an odorless gas preventing one's senses from recognizing the inherent danger.

Typically, LED light bulbs are manufactured in most any style lamp to match older incandescent bulbs, and even newer halogen, florescent, etc. type bulbs, to give illumination. These devices are very useful and use just a fraction of energy to operate them over prior art lighting technologies. Most LED lamps are produced using 120 VAC Line power (220/230 VAC depending where in the world they are marketed) as the supply voltage, to provide and easy and convenient direct replacement, and are found more and more homes, offices and industry.

While it is obvious that these independent devices have tremendous acceptance around the world, it is their independent character that leads to problematic situations. For example, even though lights are virtually everywhere in a home, should a smoke detector audibly signal an alarm, the lights do not turn on to aid in firstly, a visual signaling of the alarm, and secondly, to illuminate the affected area. Another problem is when a smoke detector signals alarm from a minor mishap; such as someone burning toast. This has virtually happened to everyone, and the results are that the smoke detector is disassembled by removing the battery to silence the 'nuisance' alarm, or if powered by line, disconnecting the line power; just to keep peace. Still another example is when these battery operated smoke and carbon monoxide/gas detecting devises run low on battery power, they emit an audible 'chirp' to indicate their battery needs to be replaced.

Although this is good and practical information, many such as elderly or the disabled, can do nothing to stop the constant chirping of a low battery smoke or carbon monoxide detector device. They must simply stay in their homes and endure the annoyance of the audible chirping until an able boded person can change-out the battery. This situation of changing batteries can be a challenge even too many so called normal people; due to lack of being able climb a step ladder or stand on a stool.

In many instances, having a light bulb that incorporates a smoke detector, carbon monoxide detector or gas detector (such as natural gas, propane gas or radon gas), and, with a rechargeable battery, would greatly reduce or eliminate the aforementioned problems. Such a device would be configured to replace any conventional light bulb in table lamps, recessed ceiling fixtures, furniture lamps, track lighting, nightlights, etc., and operate as usual with respect to lighting. When AC Line power is provided, the light will illuminate. Further the AC Line power will keep the rechargeable battery at full charge, and provide power for the detecting circuits of smoke or carbon monoxide. When the AC Line is OFF, the battery will keep alive necessary circuitry to monitor for smoke or carbon monoxide and would signal alarm if necessary.

A light bulb that incorporates a smoke, carbon monoxide or gas detectors, and, with a rechargeable battery would signal alarm both audibly and visually. The audible signal would be the familiar piercing pulsation of sound, and, the visual signaling would be a strobing alternately of high intensity white and colored LED's. The colored LED's would indicate the 'type' of danger present, such as red for smoke and amber for carbon monoxide and blue for gas (all being a dangerous environment, and, if just repeating the alarm would indicate the alarm in green strobing light;

meaning the area does not have the presence of smoke, carbon monoxide or gas; but is nearby.

In the case of an annoyance signaling of an alarm, such as the earlier mentioning of burning toast, the apparatus further would incorporate a silencing circuit. This silencing circuit would listen, between the audible pulse emissions. If it hears two sharply structured reverberations, such as in someone shouting the words (within its silencing range) "SHUT OFF" within the brief window of time, the device would suspend the alarm state, for example one minute. If the air was not cleared after that period of suspension of time, the alarm would continue. The user could tell it to shut-up again until all air is clear. No one need to remove the battery just to make peace and quiet.

An improved apparatus would also include a testing means of both the audible and visual alarming, such as by turning the apparatus ON/OFF/ON in quick succession, within one second to activate a test mode. In the test mode the alarm state will last for five second, or, be silenced via a silence command response.

In the case of a low battery situation, for example in a room that is rarely used like a guest bedroom, the device would 'chirp' as usual in prior art, if the battery gets too low. But unlike the situation mentioned above, where a helpless individual has had to endure the continued annoyance of the chirping low battery detector, the user of the present invention would simple turn the lamp or fixture ON for a short period of time. This would sufficiently re-charge the battery and chirping would immediately stop.

The present patent provides structure to effect a more efficient means to both illuminate rooms in any home or building as well as provide smoke and/or carbon monoxide and/or gas detection to signal alarm; all in one direct replaceable package, configured to any conventional light bulb of any technology. The result of this unique approach, reduces the stressful need to silence annoyance alarms by removing the battery until the air is cleared, and, the painful enduring of low battery chirping. Alarm signaling means are both audible and visual, and work either on AC Line power or its own rechargeable DC battery power.

Further, the present patent makes it favorably ease to install. One needs only to replace their current prior art light bulb with the improved LED light bulb apparatus with smoke or carbon monoxide or gas detection and signaling, of the disclosed device. A home or building could have as many of these improved light/smoke detecting (carbon monoxide detection or gas) lamps as there are fixtures, creating a network of alarm signaling devices; greatly improving the self-assurance of lives.

Further, the undesirable effects of independent lights and smoke/carbon monoxide/gas detections devices of prior art are all eliminated. If the contemplated optional short-range communications connectivity circuit is present in the device, and an alarm is activated by one unit, other similar devices within the defined range can also activate their alarms; giving further rise to a potentially dangerous situation.

This networking of these improved lighting/detecting apparatuses would give a possible safer escape route by the colored LED light at each localized alarming device. That is, red indicating smoke is present, amber indicating carbon monoxide is present, blue indicating gas is present, and green meaning neither smoke nor carbon monoxide is present, but, in a repeat alarm state to give rise of a danger within range (nearby) of another network device that is signaling a danger alarm.

Other proposals have involved illuminating alarms. The problem with these alarms is that they are not networked to each other to indicate an event in another section of the structure and also to indicate an exit pathway. Also, the batteries often run out of energy, thereby causing the alarm to be inoperable. Even though the above cited alarms meets some of the needs of the market, an apparatus used as an illuminating light bulb that also functions as an alarming device, and more particular to the detection of smoke, carbon monoxide or gas for signaling alarms of the presence thereof is still desired.

In the field of Light Emitting Diode (LED) light bulbs, there exists a need to expand their usefulness. Likewise, in the fields of smoke and/or carbon monoxide/gas detection devices, there exist a need to enlarge their utility. In countless applications of these devices, there is no crossover of functionality, where the placement of an illuminating light bulb could also signal and alarm of a deadly element present in the immediate environment: said signaling that could produce both an audible and visual alarm.

SUMMARY

Illustrative embodiments of the disclosure are generally directed to a networked visual and audible alarm apparatus and method of synchronized alerting. The alarm apparatus and method serves to provide both audible and visual alerts upon detection of at least one event, such as smoke, carbon monoxide, and gases.

In some embodiments, the alarm apparatus and method provides a plurality of alarm apparatuses configured to audibly and visually alert to at least one event, such as smoke, carbon monoxide, and general gases. The alarm apparatus also serve the dual purpose of providing normal lighting when no event is detected. In some embodiments, the alarm apparatus may include a uniquely configured light bulb that is interchangeable with a standard light bulb known in the art. The alarm apparatuses are systematically disposed through different sections of a structure, such as a building or home.

Each alarm apparatus independently emits an audible signal, dependent on the type of event detected in the respective section for the alarm apparatus. Further, each alarm apparatus provides a visual alert in the form of a high strobe light that illuminates at a color and intensity. The color and intensity for each alarm apparatus varies, dependent on the type of event detected in the section of the alarm apparatus. For example, a first alarm apparatus that detects smoke may emit an audible siren and a red light. A second alarm apparatus in an adjacent section of the structure that detects carbon monoxide may emit an audible siren and an amber light. A third alarm apparatus in another adjacent section of the structure that detects a gas (such as natural gas) may emit an audible siren and a blue light. And final, a forth alarm apparatus that does not detect smoke, carbon monoxide or gas may emit a green LED strobe array to illuminate a safe pathway for exiting the structure. Though in other embodiments, additional alarm apparatuses and colors may be used to detect other hazards known in the art.

The alarm apparatuses may also include a microphone for communicating with each other. The microphone enables an alarm apparatus to initiate the audible signal and the high strobe light upon detecting an audible signal from an adjacent alarm apparatus. In this manner, even when an alarm apparatus does not detect the event, the audible signal and a light is still initiated. This serves to indicate that there is an event occurring in another section of the structure, and also serves to create a lighted pathway towards an exit, when the alarm apparatuses are synchronized. Thus, each alarm apparatus emits an independent audible signal and high strobe light, dependent on the type of event in the specific section of the alarm apparatus.

Furthermore, the microphone operatively connects to a voice activated control portion. The voice activated control portion allows the alarm apparatus to be powered off through voice commands, such as "shut off", or "Turn off" the alarm. A rechargeable battery or a direct AC line may be used to power the alarm apparatus.

One objective of the present invention for an improved LED light bulb apparatus is incorporating a smoke detector means into the bulb envelope housing, while maintaining substantially the standard style and shape of the conventional light bulb housing.

Another object of the present invention for an improved LED light bulb apparatus is incorporating a carbon monoxide detector means into the bulb envelope housing, while maintaining substantially the standard style and shape of conventional light bulb housing.

A further object of the present invention for an improved LED light bulb apparatus is incorporating a gas, such as natural gas or propane, detector means into the bulb envelope housing, while maintaining substantially the standard style and shape of conventional light bulb housing.

An object of the present invention for an improved LED light bulb apparatus is incorporating both a smoke, a carbon monoxide and a gas detector means into the same bulb envelope housing, while maintaining substantially the standard style and shape of conventional light bulb housing.

Another objective is to incorporate the present invention into any style/type/shape housing of conventional light bulbs, lighting fixtures or lamps; making the improved apparatus disclosed herein, easily a direct replacement for any prior art devices preexisting.

One further object in said housings will have partitions, separating areas of the internal space. Typically, there are three such spaces; a LED light interior, an electronics chamber and a detector/audible horn/microphone space.

Still another object of the powering circuits is configured to any particular design need that can use a transformer-less layout, or, the use of step-down transforms. The design needs being a consideration for the end use of the present invention in any given application.

Yet another objective of the present invention for an improved LED light bulb apparatus is having an audible pulse emission means, that in an alarm state would pulsate. Such pulsation can be rhythmic, for example 3 beats ON and 1 beat OFF. This audible pattern is intended to give urgency.

Another objective of the present invention for an improved LED light bulb apparatus is to have high intensity white, and, high intensity color (such as RED for smoke and fire, amber for carbon monoxide, blue for gas, and green for a repeat alarm) LED's that strobe alternately ON while in an alarm state. Such strobing makes a visible alarm that matches the pulsation of the audible alarming and is intended to give urgency.

Still another object of the present invention is to have a 'silencer circuit'. This silencing circuit would listen, between the audible pulse emissions. If it hears two sharply structured reverberations, such as in someone shouting the words "SHUT OFF" (or the alike) within a brief window of time, the device would suspend the alarm state, for example one minute. If the air was not cleared after that period of suspension of time, the alarm would continue. The user could tell it to shut-off again until all air is clear.

An objective, is to us both the audible and visual alarming means to test, by turn the apparatus ON/OFF/ON in quick succession, within one second to activate a test mode. In the test mode the alarm state will last for five second, or, be silenced via a silence command response.

Another objective is for the same microphone listening device mentioned above, would listen for audible alarm detected pattern of sound, and if detected would repeat the alarm; thereby creating a network of two or more like apparatuses of the present invention (like in function, not housing type or style).

A further objective is a non-removable, rechargeable battery power source. The battery source having a dormant state until the end user would cause a 'one-time' activating means initialized at instillation. The rechargeable battery, to keep alive all necessary circuitry during periods when VAC Line power is not available. The battery is always kept at peak capacity when the line voltage is present, and therefore is ready to cover periods when the VAC line voltage is off.

One other object is a microprocessor or ASIC (application-specific integrated circuit) mean to control universally all aspects of operation of the present invention.

Another object is to restrict circuitry by selectively powering the apparatus of the present invention, while it is in a 'quiescent' state. That is, a state where the apparatus is not in an alarm state, and therefore can power-down unneeded drains on battery operation.

One further objective, of the present invention for an improved LED light bulb apparatus is to give audible notice when there is a low battery situation, the device would 'chirp' as conventionally usual in battery operated devices if the battery gets too low. That is, emit a very short duration pulse of sound, for example once per minute. To correct this low battery situation, the user would simply turn the present invention apparatus, lamp or fixture ON (providing AC Line power) for a short period of time. This would sufficiently re-charge the battery and chirping would immediately stop.

Finally, the last objective of the present invention for an improved LED light bulb apparatus, is to communicate via RF short range signaling, or, listen via the on-board microphone, that an alarm event was activated. The present unit, detecting the alarm situation, would alternate pulsing of audible and high intensity white and red (amber or blue) LED's for the visual signal of an event. While, any other like (in function) improved LED light bulb within range of the present unit, but not in the smoke, carbon monoxide or gas environment, would repeat the audible signaling and visual signaling of the alarm, but would not present the red, amber or blue LED pulsating, instead use a green high intensity LED's; until or when it also detected the smoke or carbon monoxide or gas. The green LED's pulsing with the white here would indicate a possible 'safer' escaping route. Thus, such an apparatus would give direction as to possible exiting away from the danger. Further, during a silence window (period of time in each alarm cycle), the repeat apparatus would listen for any sound meeting an amplitude threshold, and, if hearing none would stop the repeat alarming both audibly and strobing white and green LED's.

The present invention takes advantage of all these objectives by directly replacing a conventional light bulb, configured in any conventional style or shape, with an improved LED light bulb incorporating a smoke detector, carbon monoxide detector or gas detector; by having a non-removable rechargeable battery always available and ready to alert in both audible and visual strobing pulsations, and, can be silenced by simply telling it verbally to SHUT OFF; using any two sharply structured reverberations (words/syllables) in a sequence of speech sounds.

The improved device would be constructed to all existing lighting lamp configurations, making them easy to replace existing conventional lighting and thus make it easy to up-grade the home or building to a higher level of self-assurance. The disadvantages of prior art listed earlier are all overcome and the user of the present invention can remove older independent smoke and carbon monoxide alarming devices that require constant replacing of batteries, and are subject to annoying false triggering of the alarm, that cannot be silenced conveniently, e.g., they need to removing of the battery to silence. The improved LED light bulb apparatus of the present invention uniquely solves problems that prior art cannot.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1A:
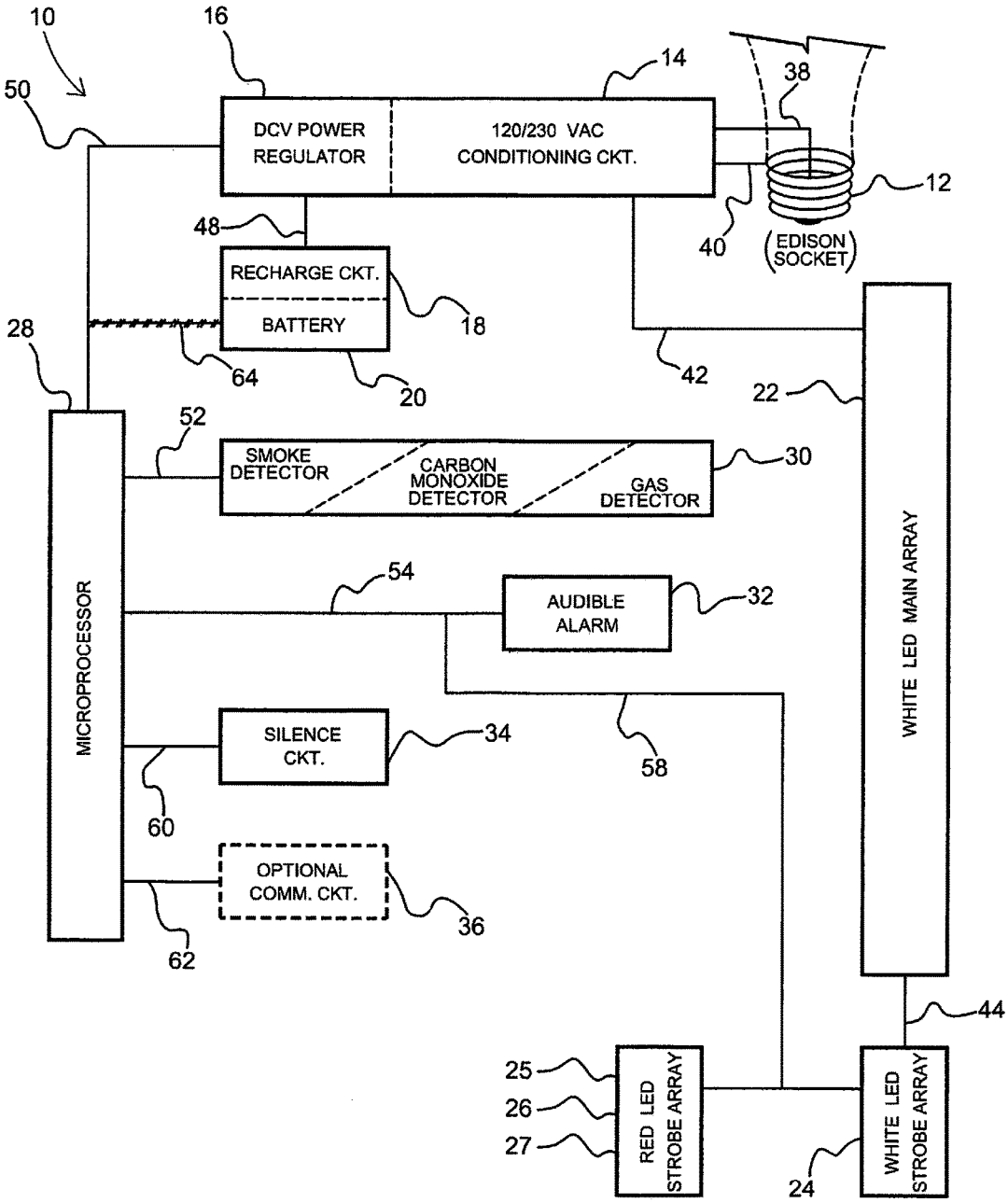
FIG. 1*a* is a block diagram of the present invention using microprocessor based components, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1*a*. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A networked visual and audible alarm apparatus 10 and method 300 of synchronized alerting is referenced in FIGS. 1*a*-13*c*. The alarm apparatus 10 serves to provide both audible and visual alerts upon detection of at least one event, such as smoke, carbon monoxide, and gases. In one embodiment, the alarm apparatuses 10 is configured to audibly and visually alert to at least one event, such as smoke, carbon monoxide, and general gases that are harmful to occupants of a structure. The alarm apparatus 10 is also adapted to operatively couple to a light bulb socket, so as to provide normal lighting when no event is detected.

In some embodiments, the alarm apparatus 10 may include a uniquely configured light bulb that is interchangeable with a standard light bulb known in the art. This is possible because the alarm apparatus 10 operatively couples into a standard light bulb socket known in the art, such as an H-A Edison A-19 style with screw base socket, an H-B flood BR-30 style screw base socket, the H-C track-light style fixture, an H-D recessed style fixture, or the H-E nightlight style fixture. In this configuration, the alarm apparatus may emit a white Led light 22.

Each alarm apparatus 10 comprises an audible alarm circuit 32 that enables independently emitting an audible signal, dependent on the type of event detected in the respective section for the alarm apparatus 10. Further, each alarm apparatus 10 provides a visual alert in the form of a colored high strobe light that illuminates at a color and intensity. The color and intensity for each alarm apparatus 10 varies, dependent on the type of event detected in the section of the alarm apparatus. For example, a first alarm apparatus that detects smoke may emit an audible siren and a red LED strobe array 26. A second alarm apparatus in an adjacent section of the structure that detects carbon monoxide may emit an audible siren and an amber LED strobe array 27 (or blue for other gases). A third alarm apparatus that does not detect smoke or gas may emit a green LED strobe array 25 to illuminate a safe pathway for exiting the structure.

In one embodiment, the audible and visual alarm emitted by the apparatus 10 is a piercing pulsation of a rhythmic pattern of colored and white lights for visual alarm, and audible sound in three beats ON to one beat OFF, giving rise to any occupants present that danger exists. Though in other embodiments, any audible and lighting pattern may be used. Further exemplary patterns may include, the rhythmic pattern of high strobe lights is alternating white high intensity LED's with red high intensity LED's for smoke, alternating white high intensity LED's with amber high intensity LED's for carbon monoxide, alternating white high intensity LEDs with blue high intensity LED's for gas, alternating white high intensity LEDs with green high intensity LED's for a repeat alarm state indicating another apparatus was alarming a danger, and along with an audible piezo-electrical horn, creating a light and sound pattern, that give a sense of urgency.

The alarm apparatus 10 may also include a microphone 204 for communicating with each other. The microphone 204 enables an alarm apparatus to initiate the audible signal and the high strobe light upon detecting an audible signal from an adjacent alarm apparatus 10. In this manner, even when an alarm apparatus 10 does not detect the event, the audible signal and a light is still initiated. This serves to indicate that there is an event occurring in another section of the structure, and also serves to create a lighted pathway towards an exit, when the alarm apparatuses are synchronized. Thus, each alarm apparatus 10 emits an independent audible signal and high strobe light, dependent on the type of event in the specific section of the alarm apparatus.

In some embodiments, a plurality of alarm apparatuses 10 may be systematically disposed through different sections of a structure 1000, such as a building or home. This is exemplified in FIG. 11*b*, which references a typical home application 1000. In this exemplary embodiment of the networking capacity of the apparatus 10, a hot water heater 1002 is on fire 1004 creating smoke 1006. The apparatus 10 nearest the hot water heater, in the same section of the structure, alerts with an audible alarm 32 and a strobing RED light 26.

The other apparatuses 10 in the structure listen to the audible alarm with a microphone, or through a radio frequency. This triggers a strobing GREEN light 25, in a repeat alarm mode. Note the transmission of alarm signals via audible sound and/or IR wireless signals for apparatus 10 to apparatus 10 are not shown but are clearly referenced in other section of this patent. Furthermore, the strobing GREEN 25 lights indicating a safe way out, as represented by arrows 1008, to evacuate the structure to safety.

In one embodiment, the smoke detector 30*a*, the carbon monoxide detector 30*b*, and the gas detectors, are operatively arranged so that a window of time elapses between audible alarm pulsations to receive audio signals via the microphone, for a command having two generated pulses above a threshold representing said command to shut-off, and suspend alarm state and wherein said partitions create a LED light interior. Also, an electronics chamber and an isolated, detector/microphone/horn space, for smoke, carbon monoxide or gas to enter and exit.

Furthermore, the microphone operatively connects to a voice activated control portion. The voice activated control portion allows the alarm apparatus to be powered off through voice commands, such as "Shut Off", or "Turn off".

A non-replaceable rechargeable battery 20 or a direct AC line may be used to power the alarm apparatus. The rechargeable battery 20 is fully integrated into the apparatus 10. The rechargeable battery 20 may include an activation means for initially putting apparatus 10 into operation. In some embodiments, the rechargeable battery 20 may include an activation pin engaged with switch, for initially putting apparatus into service with pull ribbon is removed. In this manner, if the power goes out the structure is not left in the dark. Each apparatus 10 has a lithium rechargeable battery 20 that urn the light on at 20% capacity.

FIG. 1*a* illustrates a block diagram of a preferred embodiment of the present invention 10, having an electrical connection means 12 (depicted here as the familiar Edison, 'A-19' style socket), and coupling pins 102. A 120/230 VAC conditioning circuit 14, a DCV power regulator circuit 16, a recharge circuit 18 and a rechargeable battery 20. Also is a 3/5 voltage source 136. Further is shown, a white LED main array 22, a white LED strobe array 24 and a colored LED strobe array green 25, red 26, and amber/blue 27 as they relate to the conditioning circuit 14, and, a control microprocessor 28, as it relates to the DCV power regulator 16.

The control microprocessor 28 directly controls a smoke/carbon monoxide/gas detector(s) 30*a* and 30*b*, an audible alarm circuit 32, a silence circuit 34 and a communication circuit 36. Note that the communication circuit 36 is in 'dotted line', indicating that it is a manufacturing option. The present invention can be of a simpler configuration without the communication circuit, or, the communication circuit can be present to incorporate networking features that will be disclosed in a later section. A series of lines 38, 40, 42, 44, 46, 48, 50, 52, 54, 56, 58, 60, 62 and 64 are shown providing interconnection to the various blocks or the diagram. A communication portion operatively connected to the communication circuit 36 may include a transmitter and receiver.

Conditioning circuit 14 supplies 120/230 VAC power to DCV regulator 16 and white LED main array 22, white LED strobe array 24 and a colored LED strobe array green 25, red 26, and amber/blue 27. The DCV power regulator provide commercial power for charging the battery 20 by the recharge circuit 18, and all of the other control components 28, 30, 32, 34, 36. In operation, when 120/230 VAC (Line Voltage) is available and present at the electrical connection means 12, the apparatus functions as follows: Conditioning circuit 14 steps-down and rectifies the VAC Line Voltage first, to the high intensity light emitting diodes (LED's) in the arrays 22 and 24, providing illuminances in the emission of visible light, and second, provide power to the DCV regulator 16 that supplies control power and the recharging of the battery as needed. Should the Line Voltage be OFF, or not present, the battery 20 will supply all necessary power to circuits 28, 30, 32, 34, 36 and the two LED strobe arrays 25, 26 and 27, 24 when in the alarm state.

It is important to understand that the white LED's in the strobe array 24 function with, and exactly the same as, white LED's in the main array 22. Only when in battery mode of operating, do the white LED's strobe the array 24, should there be an alarm. A more detailed description of all these functions will be disclosed later.

Figure 1B:
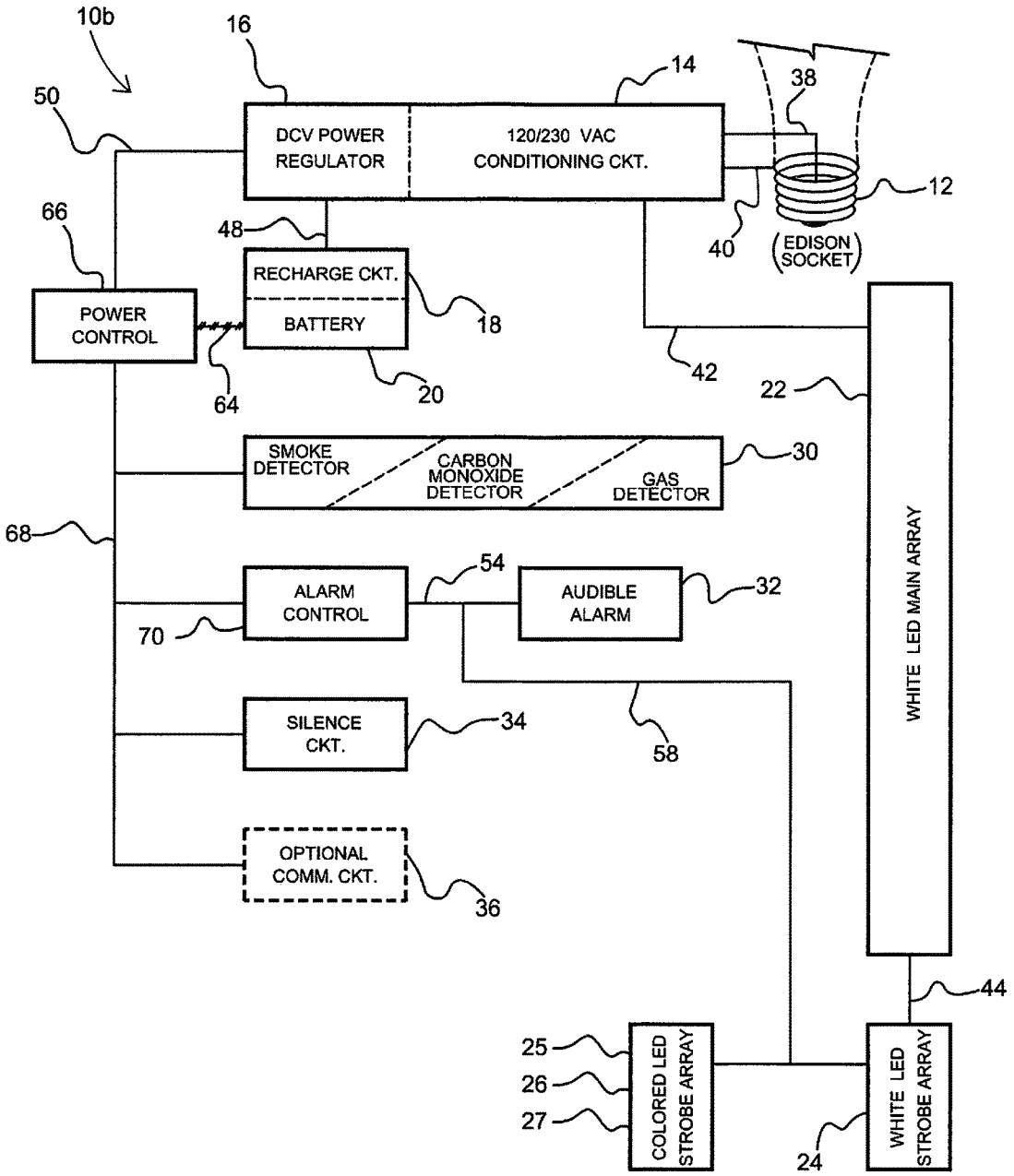
FIG. 1*b* is a block diagram of an alternate embodiment of the present invention using discrete components, in accordance with an embodiment of the present invention.

Moving to a first alternate embodiment having discrete components in FIG. 1*b*, where it is shown a block diagram of the present invention 10*b*, discrete components, having an electrical connection means 12 (depicted here as the familiar Edison, 'A-19' style socket). A 120/230 VAC conditioning circuit 14, a DCV power regulator circuit 16, a recharge circuit 18 and a rechargeable battery 20. Further is shown, a white LED main array 22, a white LED strobe array 24 and a colored LED strobe array green 25, red 26, and amber/blue 27, as they relate to the conditioning circuit 14, and, a monitor circuit 66, as it relates to the DCV power regulator 16. The monitor circuit 66 oversees a smoke/carbon monoxide/gas detector(s) 30, an alarm control 70 (with audible alarm circuit 32), a silence circuit 34 and a communication circuit 36.

Note that the communication circuit 36 is in 'dotted line', indicating that it is a manufacturing option. The present invention can be of a simpler configuration without the communication circuit, or, the communication circuit can be present to incorporate networking features that will be disclosed in a later section. A series of lines 38, 40, 42, 44, 46, 48, 50, 54, 56, 58, 64 and 68 are shown providing interconnection to the various blocks or the diagram.

Conditioning circuit 14 supplies 120/230 VAC power to DCV regulator 16 and white LED main array 22, white LED strobe array 24 and a colored LED strobe array 26. The DCV power regulator provide commercial power for charging the battery 20 by the recharge circuit 18, and all of the other control components 66, 30, 70, 32, 34, 36.

In operation, when 120/230 VAC (Line Voltage) is available and present at the electrical connection means 12, the apparatus functions as follows: Conditioning circuit 14 steps-down and rectifies the VAC Line Voltage first, to the high intensity light emitting diodes (LED's) in the arrays 22 and 24, providing illuminances in the emission of visible light, and second, provide power to the DCV regulator 16 that supplies control power and the recharging of the battery as needed.

Should the Line Voltage be OFF, or not present, the battery 20 will supply all necessary power to circuits 66, 30, 70, 32, 34, 36 and the two LED strobe arrays 25, 26 and 27 and 24 when in the alarm state. It is important to understand that the white LED's in the strobe array 24 function with, and exactly the same as, white LED's in the main array 22. Only when in battery mode of operating, do the white LED's strobe the array 24, should there be an alarm. A more detailed description of all these functions will be disclosed later.

Figure 2A:
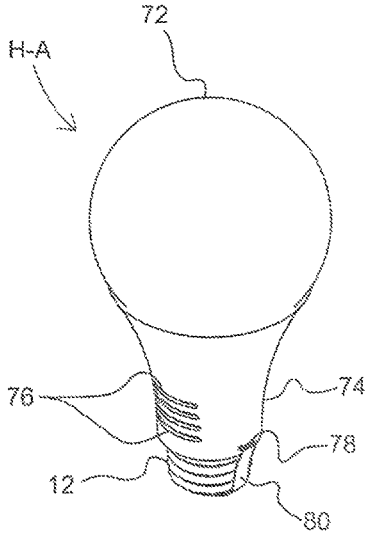
FIG. 2*a* is a perspective view showing the outside of a common 'Edison' style, type A19 light bulb envelop housing, in accordance with an embodiment of the present invention.

Turning now to FIG. 2*a* is shown a perspective view of the outside of a common 'Edison' style, type A19 light bulb 'envelop', housing H-A. The housing H-A having electrical connection means 12, as depicted in FIGS. 1*a* and 1*b* earlier. A light-defusing reflector 72, an electronics casing 74, a series of vents 76, an activating pin 78 and pull ribbon 80 are also shown. The light-defusing reflector 72 allows an even emission of illumination when the LED's of the main array 22, strobe arrays 24 and 25, 26 or 27 are turned ON. The electronics casing 74 holds the operating components of the present invention and has vents 76 to allow smoke and/or carbon monoxide and/or gas to enter and exit the housing H-A.

The vent 76 also allows sound to enter and exit the housing H-A. The activating pin 78 with ribbon 80, when removed from housing H-A, will actuate an internal means (as will be disclosed later), to initiate operations. Since the ribbon 80, intentionally covers a portion of the electrical connection means 12, the apparatus H-A cannot be installed into a lamp until the pin 78 is removed, thus bringing to life the battery system and the electronics. This is important to understand, because the pin 80 will keep the battery from being depleted prior to the apparatus is brought into service.

Figure 2B:
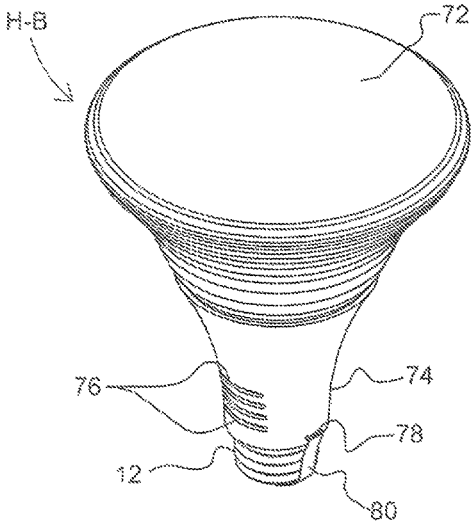
FIG. 2*b* is a perspective view showing the outside of a common 'flood' style, type BR-30 light bulb envelop housing, in accordance with an embodiment of the present invention.
Figure 2C:
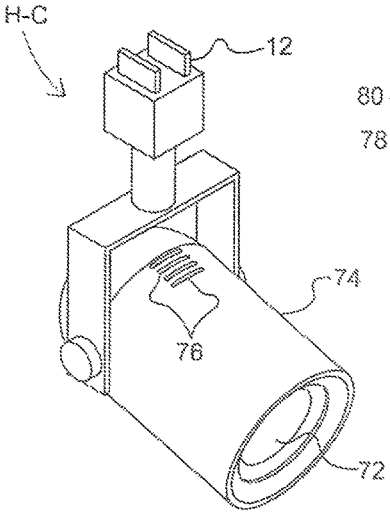
FIG. 2*c* is a perspective view showing the outside of a common 'track' style, light housing, in accordance with an embodiment of the present invention.
Figure 2E:
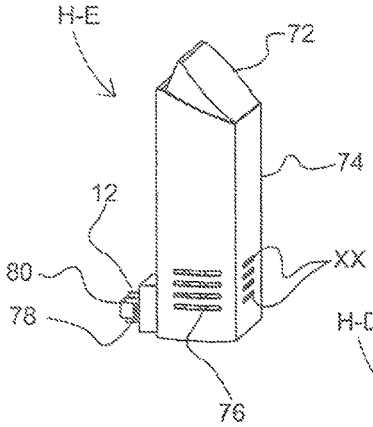
FIG. 2*e* is a perspective view showing the outside of a common 'nightlight' style, light housing, in accordance with an embodiment of the present invention.
Figure 2D:
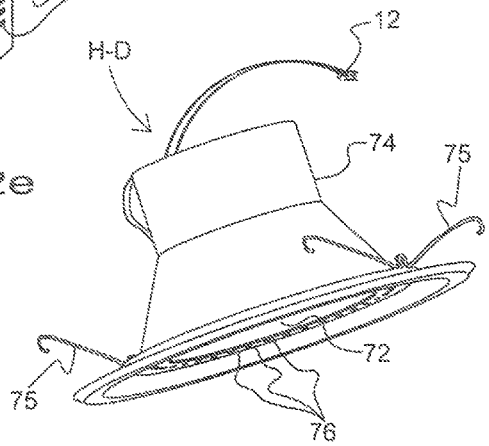
FIG. 2*d* is a perspective view showing the outside of a common 'recessed' style, light housing, in accordance with an embodiment of the present invention.

FIG. 2*b* through FIG. 2*e* are all the same in function and operation as disclosed in FIG. 2*a*; only the form has changed as follows. FIG. 2*b* being a perspective view showing the outside of a common 'flood' style, type BR-30 light bulb envelop housing H-B; FIG. 2*c* is a perspective view showing the outside of a common 'track' style, light housing H-C; FIG. 2*d* is a perspective view showing the outside of a common 'recessed' style, light housing H-D; and, FIG. 2*e* is a perspective view showing the outside of a common 'nightlight' style, light housing H-E. Each housing H-B, H-C, H-D and H-E respectively, holding the present invention 10 (as will be seen in FIG. 3) and operating as disclosed in FIG. 1*a* or 1*b*.

Figure 3A:
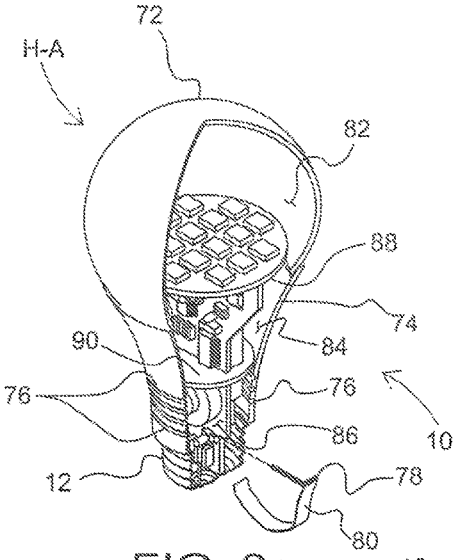
FIG. 3*a* is a perspective view with cut-away showing the inner chambers and components of a common 'Edison' style, type A19 light bulb envelop housing, in accordance with an embodiment of the present invention.

Moving to FIG. 3*a* is a perspective view with cut-away showing the inner chambers and components of a common 'Edison' style, type A19 light bulb envelop, housing H-A. A LED light interior 82, an electronics chamber 84 and a detector and microphone space 86 are shown, and created by, a LED mounting plate 88 and a partition 90. The LED mounting plate 88 also is a heat-sink to dissipate any heat generated by the LED's when they are turned ON. The partition 90 keeps smoke and or carbon monoxide and or gas that may enter the vents 76, isolated only to the detector, horn and microphone space 86.

Figure 3B:
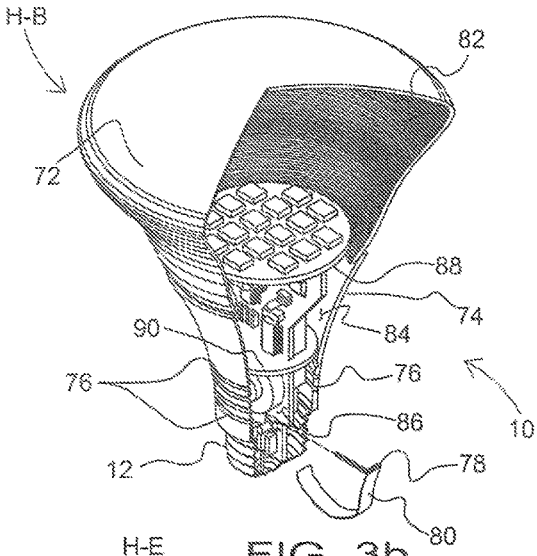
FIG. 3*b* is a perspective view with cut-away showing the inner chambers of a common 'flood' style, type BR-30 light bulb envelop housing, in accordance with an embodiment of the present invention.
Figure 3E:
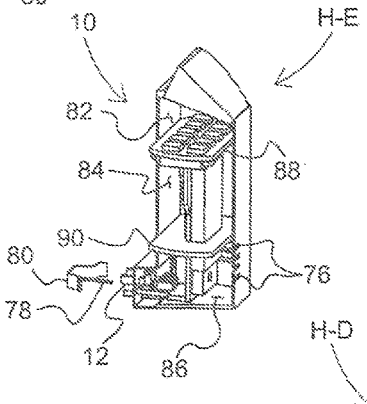
FIG. 3*e* is a perspective view with cut-away showing the inner chambers of a common 'nightlight' style, light housing, in accordance with an embodiment of the present invention.
Figure 3C:
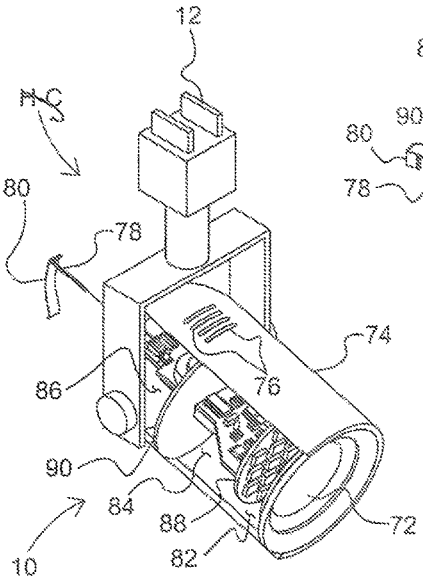
FIG. 3*c* is a perspective view with cut-away showing the inner chambers of a common 'track' style, light housing, in accordance with an embodiment of the present invention.
Figure 3D:
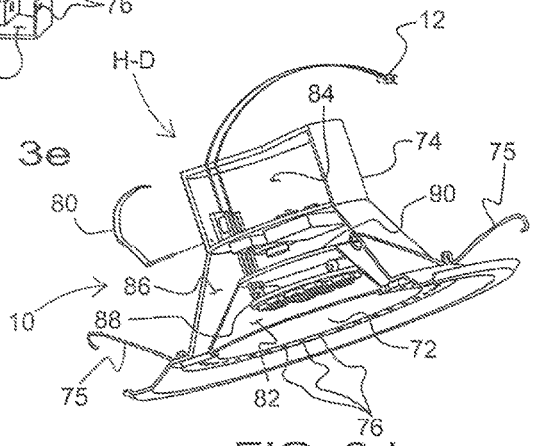
FIG. 3*d* is a perspective view with cut-away showing the inner chambers of a common 'recessed' style, light housing, in accordance with an embodiment of the present invention.

Again with FIG. 3*b* through FIG. 3*e*, all the same in function and operation as disclosed in FIG. 3*a*; only the form has changed as follows. FIG. 3*b* is a perspective view with cut-away showing the inner chambers of a common 'flood' style, type BR-30 light bulb envelop housing H-B; FIG. 3*c* is a perspective view with cut-away showing the inner chambers of a common 'track' style, light housing H-C; FIG. 3*d* is a perspective view with cut-away showing the inner chambers of a common 'recessed' style, light housing H-D, and FIG. 3*e* is a perspective view with cut-away showing the inner chambers of a common 'nightlight' style, light housing H-E. Each housing H-B, H-C, H-D and H-E respectively, holding the present invention 10 (as will be seen in FIG. 3) and operating as disclosed in FIG. 1*a* or 1*b*.

Although the inventors have disclosed five (5) styles of light bulbs and lamp fixtures, it is explicitly understood that the present invention 10 can be fitted into any light/lamp housing style or type of fixture. For example, a few other standard 'series' types are: A-Series, B-Series, C7/F Series, CA-Series, S-Series, F-Series, RP, MB, BT Series, R-Series, MR-Series, PS Series, AR-Series, ALR-Series, BR-Series PAR-Series, T-Series, BT-Series, ED-Series. Further there are the European Base E-Series, the Bayonet Series, the high voltage series as well as the low voltage pin series, and the G-Series including fluorescent tube.

Still there are more, but the inventors have clearly shown an improved LED light bulb with alarming apparatus for smoke, carbon monoxide and gas detection, in five different configurations of commonly found lighting devices that are shown here are sufficient enough, for anyone skilled in the art, to understand the invention, and, were only limited by the practical need to keep this disclosure shorter in length.

Figure 4A:
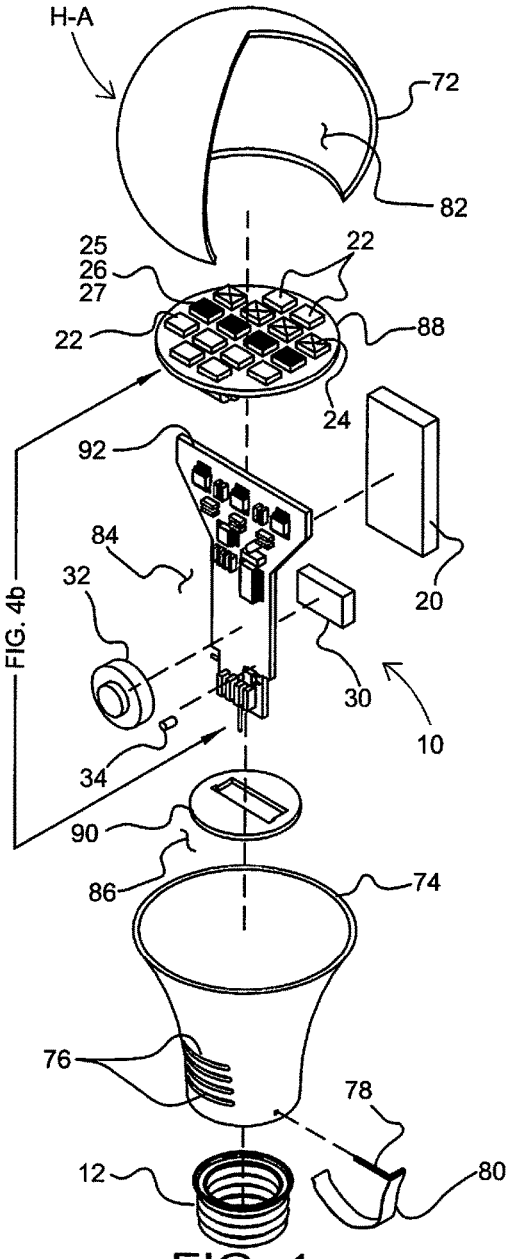
FIG. 4*a* is an illustration of the present invention of FIG. 2*a* showing an exploded view of one possible layout of components, in accordance with an embodiment of the present invention.

FIG. 4*a* is a perspective view illustration of the present invention of the H-A housing in FIG. 2*a*, showing an exploded view of one possible layout of components. The partially cut-away light-defusing reflector 72, revealing the LED light interior 82 space and the LED mounting plate (with heat sink) 88. The LED mounting plate 88 has disposed on it, the high intensity white LED main array 22, the high intensity white LED strobe array 24 and the high intensity colored LED strobe array, green 25, red 26 and amber and blue 27. The colored LED's strobing would give the visual alarm and will be further discussed later.

Figure 4B:
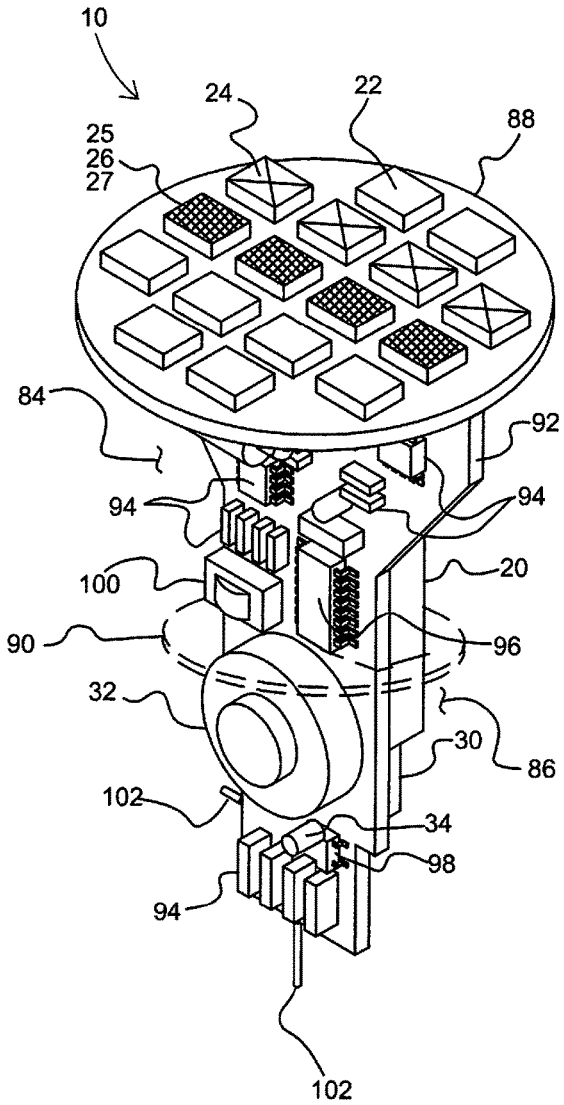
FIG. 4*b* is an assembled detail of the present invention as it would fit into the Edison style A-19 housing of FIG. 2*a*, in accordance with an embodiment of the present invention.

The electronics chamber 84 'space' has within, a print circuit board (PCB) 92. Disposed on the PCB 92, are the rechargeable battery 20, smoke/carbon monoxide/gas detectors 30, the audible alarm 32 horn/siren, and the silence circuit 34 microphone. (Note the optional communications circuit 36 also disposed in this section of PCB 92, will be discussed later.) The lower portion of the PCB 92 is isolated via partition 90; which is positioned just above audible siren/horn 32 and smoke/gas/detector 30, and, thereby creates the detector, horn and microphone space 86. FIG. 4*b* will better detail this section of the assembly in greater clarity.

Finally, the electronics casing 74 provides cover for the above assembly, including 88, 92 20, 30, 32, 34 and 90 just mentioned. Note the lower section, at the detector and microphone space 86 area, has the vents 76 to allow smoke and/or carbon monoxide and/or gas to flow into and out of space 86, as well as, to allow sound to emanate therefrom via the audible siren/horn 32, and, hear external sound via silence circuit 34 microphone. The vents 76, in the preferred embodiment, have disposed on the inner surface of electronics casing 74, a screen (not shown for clarity of presentation) to prevent object from entering the casing 74 vent holes; only smoke, gas or sound can freely enter and exit the space 86 as disclosed.

Look now at FIG. 4*b* to see a detail of the present invention 10, showing the improved LED light bulb with alarming apparatus for smoke, carbon monoxide and gas detection assembly as it would fit into the Edison style A-19 housing of the exploded view of FIG. 4*a*. Here is shown LED arrays 22, 24 and 25, 26 and 27 disposed atop LED mounting plate 88. The mounting plate 88 is conventionally constructed with circuit current flow patterns on the LED top-side, and with a heat sink (such as aluminum) on the bottom-side. The number of high intensity LED's, in both the main 22 and strobe 24 and 25, 26 and 27 arrays, are defined by the amount of luminescence desired.

In this example of the A-19 style bulb, H-A of FIG. 2*a*, are twelve of the white LED's in the main 22 and strobing 24 arrays, during normal lighting functions. While there are four of the colored LED's strobing 25, 26 and 27 'alarm state'. It should be understood that any number of LED's, either greater or less, can be implemented on to LED mounting plate 88 to facilitate any given housing configuration and desired lumens.

The PCB 92 having the partition 90 shown in dashed line for clarity of presentation. The PCB 92 and the LED mounting plate 88 are electrically connected (not shown) using simple conventional 'pin' connection devices meant for mating two printed circuit boards; at the top edge of 92 and the bottom surface of 88. Operating current and signals flow over said connecting pins. A variety of electronic, surface mount electronic components 94, integrated circuits 96 and step-down (means) transformer 100 are disposed on PCB 92. These components will be detailed in a later section. On the underside of the partition 90, at the lower end of PCB 92, is disposed the audible alarm siren/horn 32, silence circuit 34 microphone and smoke/carbon monoxide/gas detector(s) 30. Further is disposed an activation means 98 (which is engaged with activation pin 78).

In the preferred embodiment the activation means 98 is a switch that is positioned during manufacturing. The switch, activation means 98, isolates the rechargeable battery 20, so none of the circuits are powered, until and when, the activation pin 78 is removed via the pull ribbon 80 during installation of the device into service. It is important to understand that once the activating pin 78 is removed, and the switch, activation means 98 is toggled, the switch cannot be toggled back to an OFF position again. Thus the device is fully functional for its service life. A further disclosure of these functions will be detail later.

Further disclosures are seen in FIGS. 5 through 10, where there is shown typical circuitry to make functional the blocks in FIGS. 1*a* and 1*b*. The inventors use the words 'typical circuitry' here, specifically to emphasize that there are many ways to achieve the form and function described in the blocks of FIGS. 1*a* and 1*b*, and, although there is a preferred way, it should not be construed that it is the present invention. But rather that the descriptions in FIGS. 1*a* and 1*b*, comprising the form and function, as well as what is disclosed in these teaching, are the present invention. Also, please note that the circuits are shown with only the main components, omitting support components for simplicity of presentation and clarity.

Figure 5A:
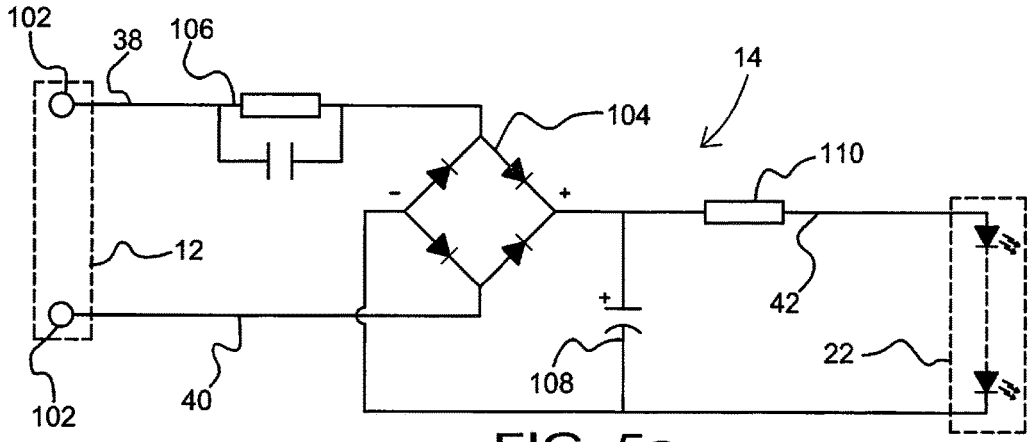
FIG. 5*a* is a schematic sketch of one possible configuration of the 230/120 VAC conditioning circuit 14 in FIGS. 1*a* and 1*b*, using a limiting resistor to control current, in accordance with an embodiment of the present invention.
Figure 5B:
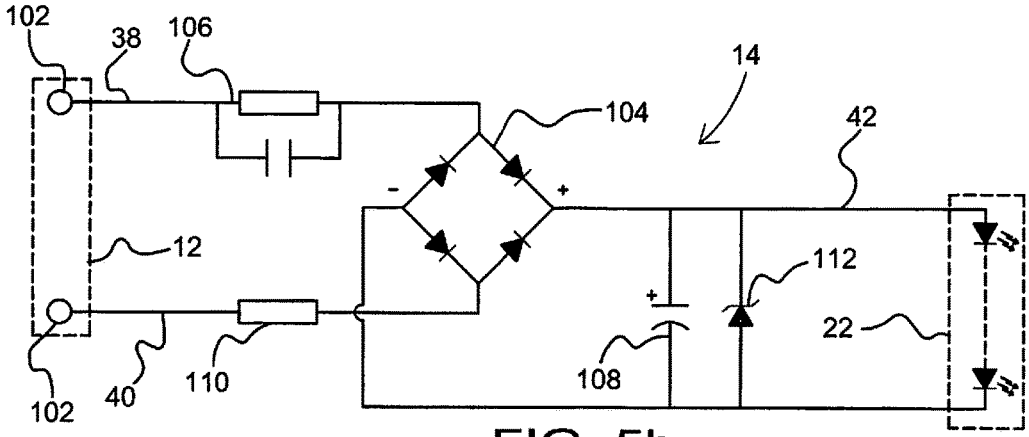
FIG. 5*b* is another a schematic sketch arrangement of FIG. 5*a*, configured with a Zener diode to control voltage, in accordance with an embodiment of the present invention.

Now referring to FIG. 5*a*, it is shown a typical 'transformer-less' 120/230 VAC conditioning circuit 14, having a full bridge circuit 104 and a limiting resistor/capacitor network 106 on the VAC side of the bridge, a filtering capacitor 108 and a limiting resistor 110 on the DCV side. The conditioning circuit functions to convert alternating current to direct current, and provides a suitable power supply to the (main 22 and strobing 24 and 25, 26 and 27) LED arrays. FIG. 5*b* is shown the addition of a Zener diode 112. In this configuration, the Zener diode 112 would limit the voltage, for example, to 69 volts, which is one way to 'step-down' and achieve the power supply required by the physical number of LED diodes in the lighting circuit 22, 24 and 25, 26 and 27.

Figure 5C:
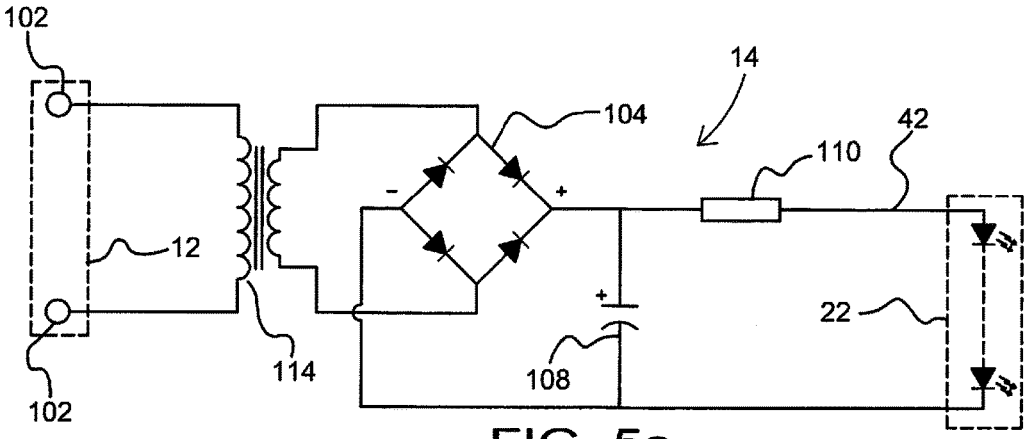
FIG. 5*c* is one more schematic sketch of a configuration of the 230/120 VAC conditioning circuit Block 14 in FIGS. 1*a* and 1*b*, using a step-down transformer, in accordance with an embodiment of the present invention.

Alternatively, FIG. 5*c* shows the same means as shown the FIGS. 5*a* and 5*b*, but with the use of a step-down transformer 114. Here the step-down transformer 114 would present to the bridge 104 a lower voltage before rectifying it to a DCV. Any of these 120/230 VAC conditioning circuits are suitable, but the present patent is not limited to just these examples, and that there are other configurations that would work equally as well.

Figure 6:
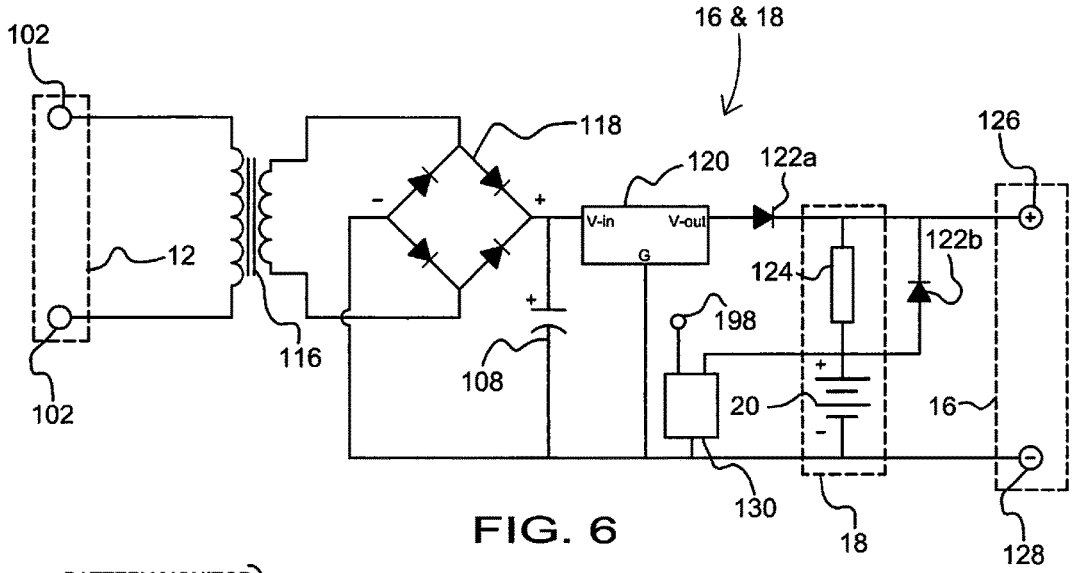
FIG. 6 discloses a schematic sketch circuitry for a DCV power regulator Block 16, recharge circuit Block 18 and battery 20 in FIGS. 1*a* and 1*b*, in accordance with an embodiment of the present invention.

FIG. 6 shows a similar function of FIG. 5*c* to suppling power, but here it is specifically to regulate the DCV for the systems electronic controls. In this example, it is shown that a step-down transformer 116, a full bridge 118, a fixed voltage regulator 120 (LM7812 Series), an isolation diodes 122*a* and 122*b* (1N4007 type), and a limiting resistor 124, all provide suitable regulation to; 1.) recharge circuit 18 for the battery 20, and 2.) supply operation DCV to drive the electronics 16. When line VAC is available, regulated DCV is supplied to positive terminal 126 via diode 122*a*, and is charging battery via limiting resistor 124. When the line VAC is not present, the battery 20, without any interruption, supplies the DCV via diode 122*b* to positive terminal 126.

The battery 20 has a battery monitoring circuit 130. The battery monitoring would activate the chirp signal in the event the battery 20 should drop below a minimum threshold. Although the step-down transformer 116, DCV regulator 120 and battery 20 can be of any suitable operating voltage, the preferred embodiment of the present invention it is in the 12 volts DC range, and, the battery is a rechargeable lithium ion battery. Please note that other voltages may be needed to function the apparatus 10. Such voltages may be 3 or 5 volts for some electronics. These voltages would be generated by a similar circuit that is disclosed here in FIG. 6.

Figure 7A:
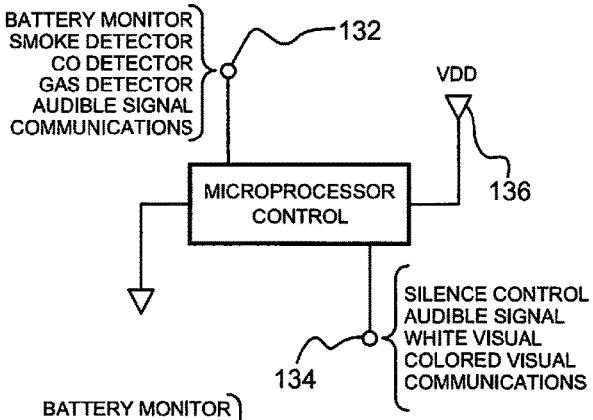
FIG. 7*a* is microprocessor based illustration of Block 28 providing central control of all aspects of the present invention, in accordance with an embodiment of the present invention.

In FIG. 7*a*, the microprocessor control 28 would use the 3 or 5 volts as indicated in the previous paragraph and control most aspects of the apparatus 10 via receiving input from an input 132 'read process', and, drive control output from an output 134 'write process'; utilizing program code specifically for these functions listed in FIG. 7*a*. A suitable microprocessor would be one of the Microchip Corporation, PIC series, such as their 8-pin, 14-pin or 20-pin models. Preferably one with built-in program memory, random access memory and peripheral select ability. Each of these models can be programmed, by any one skilled in the art, to produce the function describe throughout this disclosure referencing the apparatus of the present invention 10, controlling the various circuits as indicated in FIG. 1*a*.

Figure 7B:
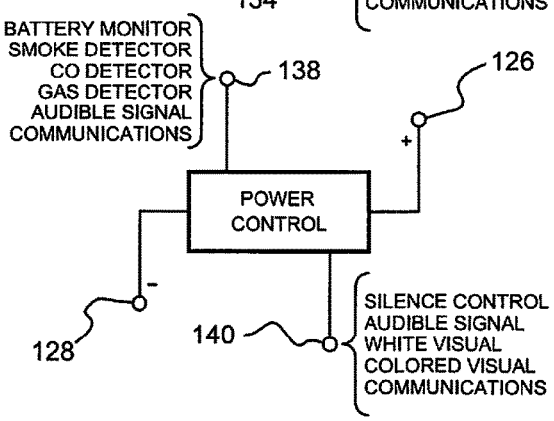
FIG. 7*b* illustrates a discrete components Block 66 version of 7*a*, in accordance with an embodiment of the present invention.

In FIG. 7*b*, the results are similar to the results described in FIG. 7*a*, but using discrete electronic components operating in logical manner. Here the power control 66, operating on system DCV power (see FIG. 6) via terminal 126 and 128 to receive an input 138 and drive an output 140. The power control would produce the function describe throughout this disclosure referencing the apparatus of the present invention 10, controlling the various circuits as indicated in FIG. 1*b*.

Those skilled in electronics would be able to assemble such discrete components configured to operate and function as described. It is highly desirable to miniaturize all said circuits indicated in both FIGS. 7*a* and 7*b*, and as such the use of an ASIC (Application Specific Integrated Circuit) is most useful. The inventers would employ such ASIC technology into the present invention apparatus 10, substantially reducing the component count, when designing a particular end use device.

Figure 8A:
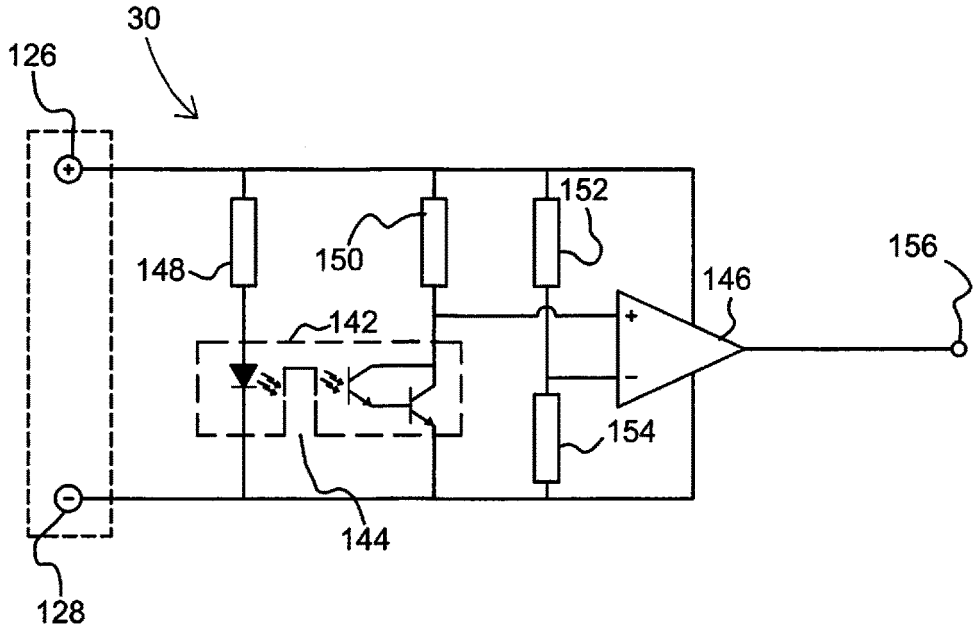
FIG. 8*a* is a schematic sketch showing electrically the smoke detection process, in accordance with an embodiment of the present invention.

Turning next to FIG. 8*a*, where it is disclosed a schematic sketch showing electrical side of the smoke/carbon monoxide/gas detector 30 sensing elements of the present invention. A photo-interrupter 142, a signal condition means 146, a current limiting resistors 148 and 150, and a signal balancing resistors 152 and 154. The photo interrupter 142 smoke detecting sensor, having a smoke entry port 144, for the entry of smoke when it is present. The limiting resistor 148 restricts current flow in the infrared emitting diode within the sensor 142, likewise, the limiting resistor 150 restricts current flow within the 'darlington' photo transistors of the isolated output of the device 142.

The sensor 142 can be of any smoke detecting means, either reflective or transmissive, but the preferred embodiment is a Sharp Microelectronics, PN#GP1L52VJ000F transmissive device. When smoke is detected the amplified darlington output of the sensor 142 changes the current flow to the plus input of the signal conditioning means 146. In this example of a detecting circuit, operational amplifier is a conventional LM741 type amplifier, that can then go directly the audible and LED strobing circuits (that will be described later) via 156. If a microprocessor is use, as it in FIG. 1*a*, the darlington output of the sensor could directly be seen as a peripheral, and have no need for the amplifier circuit 146 device.

Figure 8B:
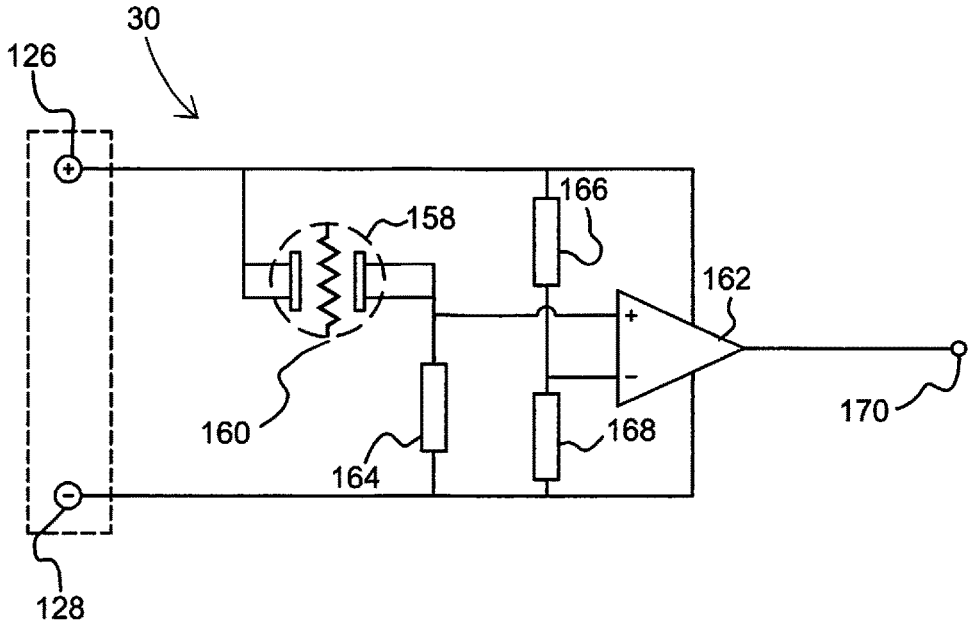
FIG. 8*b* is a schematic sketch showing electrically the carbon monoxide detection process, in accordance with an embodiment of the present invention.

Similar to FIG. 8*a* circuitry, in FIG. 8*b* a carbon monoxide (gas) sensor 158 having a measuring resistance surface 160, a signal conditioning means 162, a limiting resistor 164 and a signal balancing resistors 166 and 168 are connected electrically for such purpose of detecting CO and gases, and, having an output 170. Again, any CO, ionization gas sensor would work but the preferred device would be the MQ-7 Gas Sensor manufactured by Hanwei Electronics Co., LTD. An electro-chemical means can be utilized to specific target for gas types, in a more exotic application of the present invention; such as natural gas, propane gas, radon gas, etc.

It is explicitly understood that the present invention 10, can have either one of the smoke, carbon monoxide or gas sensors, or, any combination or all such sensors incorporated into a single device of the apparatus 10. Also, the components shown in the FIGS. 8*a* and 8*b* are just representative to show intent of the main components, and, other supporting circuitry is intentionally not show for the clarity of presentation. Any one skilled in the art of electronics could appreciate the inventors' disclosure of the present invention and understand its meaning.

Figure 9:
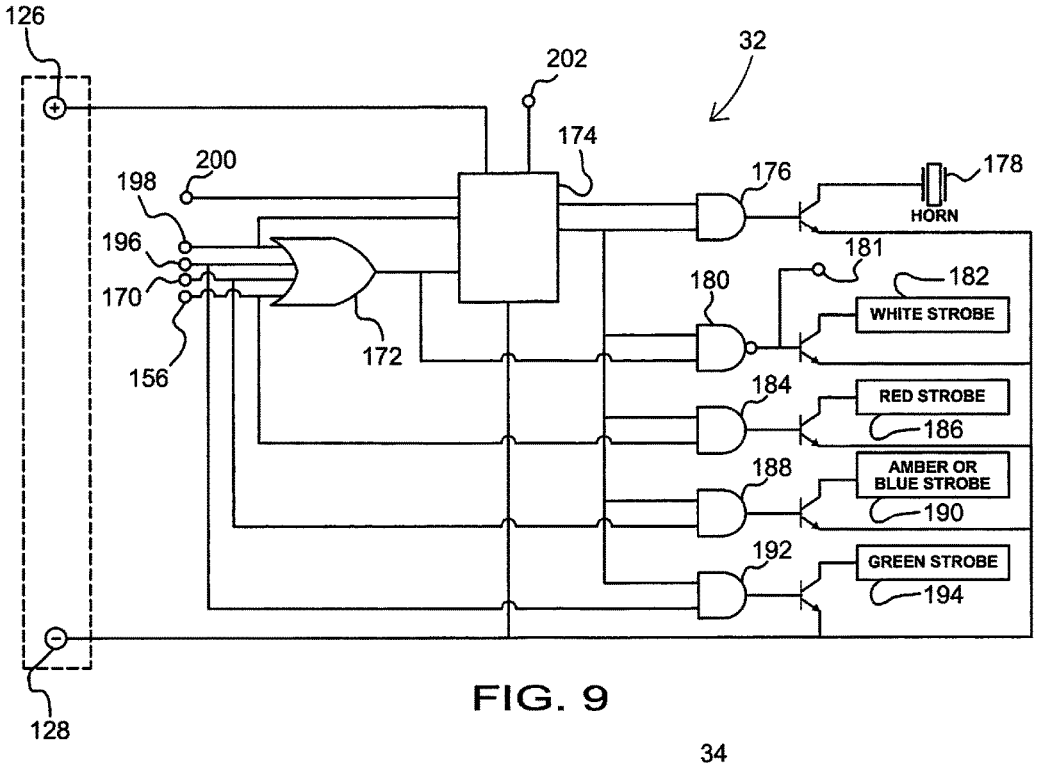
FIG. 9 is a schematic sketch showing electrically the timing management of various signals that create the controlling waveforms of the present invention including the out driving circuits of sound and strobing LED's, in accordance with an embodiment of the present invention.

Now in FIG. 9 is shown the audible/visual alarm 32 control. An 'OR' logic gate 172, a timer/counter circuits 174, an 'AND' logic driver circuit 176, a piezo electric horn 178, a 'NAND' logic driver gate 180, an 'AND' logic driver gates 184, 188, and 192, a high intensity white LED's 182, a high intensity red LED's 186, a high intensity amber of blue LED's 190, and a high intensity green LED's 194. The 'OR' gate receives signals: smoke detected signal active 156, carbon monoxide/gas detected signal active 170, repeat alarm signal active 196, and low battery signal active 198. Any of the four signals presented to the 'OR' gate 172, would output a logical high to activate the timer/counter circuit 174, which in turn would signal the driver circuits 176, 180, 184, 188 and 192.

The driver circuit 176 would output to the piezo electrical horn 178, while the other driver circuits would strobe the LED's 182, 186, 190 and 194 (referred to a blocks 24, 26, 27 and 25 respectively in FIGS. 1*a* and 1*b*). The color of the LED circuits would depend on which of the signals received at the 'OR' gate 172. That is, smoke detected signal active 156 would also be at the red 'AND' driver circuit 184, carbon monoxide or gas detected signal active 170 would also be at the amber or blue 'AND' driver circuit 188, and the repeat alarm signal active 196 would also be at the green 'AND' driver circuit 192. The white 'NAND' driver circuit 180 would be inverted from the other colored LED 'AND' driver circuits, creating a pattern of white lighted strobing LED's, in between a colored strobing LED's.

This pattern will be fully detailed later in a waveform section of this disclosure. The white 'NAND' driver circuit also outputs a main array strobe signal 181. As will be disclosed is FIG. 13, the main array strobe signal (connected to the gate of an SCR switching device) will interrupt the lighted main array 22 if powered; causing it to strobe in unison with the colored arrays described earlier. An activate microphone signal 202 is generated via timer/counter circuit 174 and sets the timing in which the microphone will listen for the silence command as is referenced on FIG. 10 (also see waveforms of such timing in FIG. 12). The low battery signal active 198 is generated from the battery monitoring circuit 130 referenced on FIG. 6, and when is active, the horn 178, with white strobe LED's will 'chirp', or be ON for a very short amount of time to indicated a low battery state.

Figure 10:
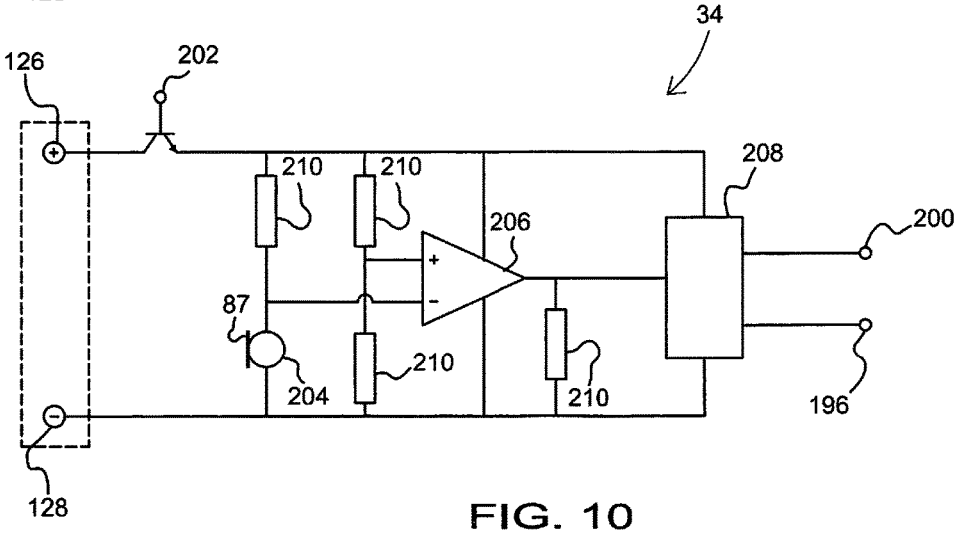
FIG. 10 is a schematic sketch showing electrically the silence circuit and the microphone control, in accordance with an embodiment of the present invention.

FIG. 10 is the silence circuit 34 having an activate microphone signal 202, a condenser microphone 204, an operational amplifier circuit 206, a counter/divider circuit 208, a supporting circuit resistors 210, a silence alarm signal active 200, and a repeat alarm signal active 196. When a signal is present at switching device; activate microphone signal 202, will power the listen capability of the silence circuit 34.

In this manner, any audible sound within range of the condenser microphone 204 is present to the operational amplifier 206. When the signals, from the microphone, meet the predetermined amplitude level as is set forth via the supporting circuit resistors 210, the operational amplifier would output such a signal, for the duration of the said signal above predetermined amplitude level; to the counter/divider circuits 208. If there are two such predetermined amplitude level signals, generated within the window of time presented by the activate microphone signal 202, then, the counter/divider circuits 208 would output a valid silence alarm signal active 200.

Referring to FIG. 9, the silence alarm signal active 200 is seen via the timer/counter circuit 174, whereby the alarm state is suspended, for example one minute. Referring back to counter/divider circuits 208, a repeat alarm signal active 196 is generated when operational amplifier circuit 206 sees a pattern of meeting the predetermined amplitude level in three consecutive beats in three alarm cycles. When the apparatus 10 of the present invention is in a quite or quiescent state, the timer/counter circuits generate a very short activation of microphone signal 202. If no predetermined amplitude level is seen by the counter/divider circuit 208, the activate microphone 202 is immediately shut OFF.

But if a single predetermined amplitude level is present at 208, then the circuit 202 stays active and will listen for the aforementioned three consecutive beats in three alarm cycles. This would have indicated that a nearby, other apparatus 10 within range, was alarming, and, the repeat alarm signal would be generated via counter/divider circuits 208 at output 196 repeat alarm signal active. This activation would drive the green LED's 194, on FIG. 9. These functions described in FIGS. 9 and 10 will be better appreciated and be more fully detailed in the following state and waveform sections of this disclosure.

A suitable counter/divider 208 would be a CD4017 and operational amplifier 206 would be a LM741 and are both manufactured by Texas Instruments. A suitable condenser microphone 204 would be a CME-5042PF-AC, manufactured by CUI, Inc.

Figure 11A:
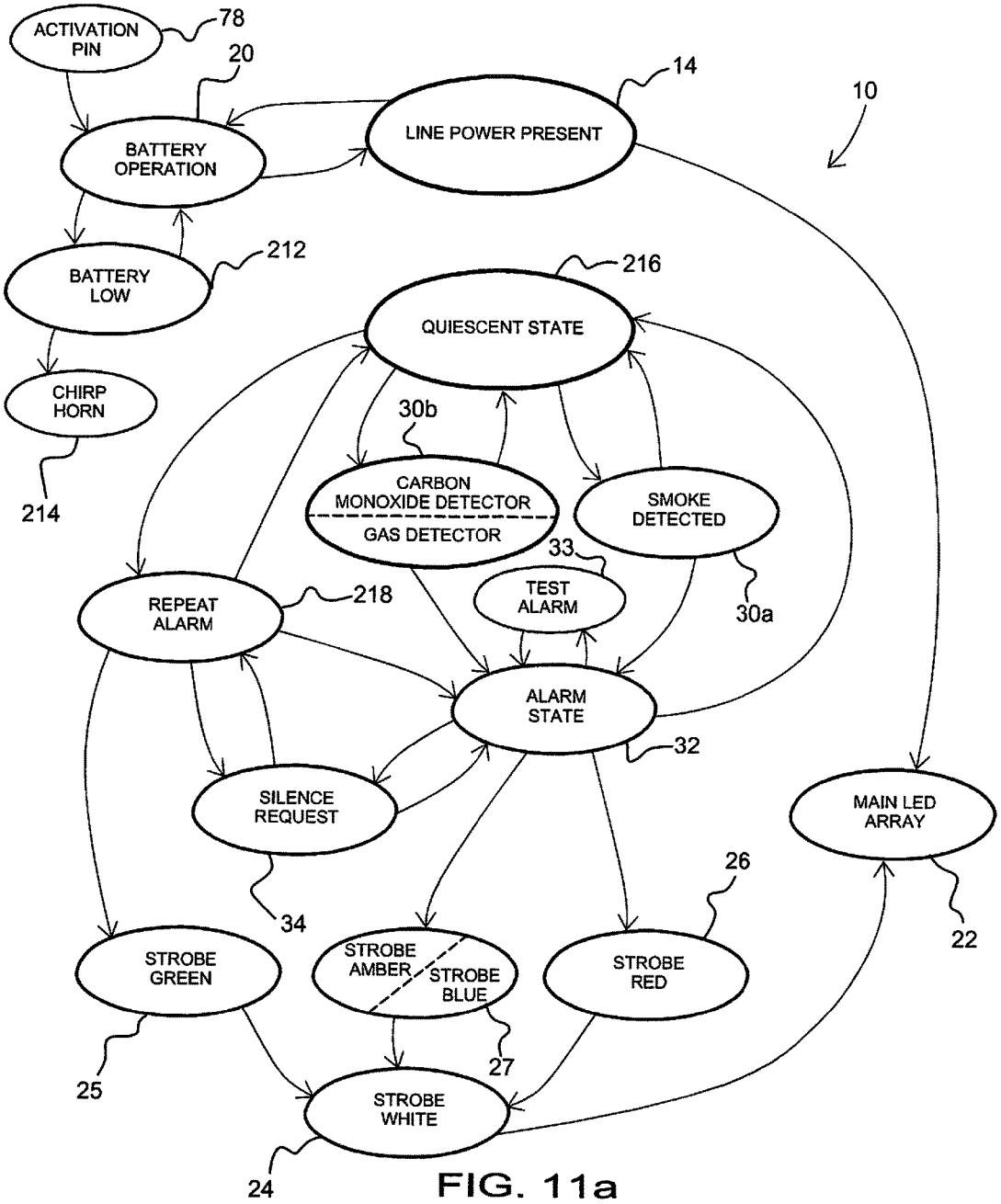
FIG. 11*a* is a state table, illustrating the various possible operating mode the apparatus can be in, and how it navigates between states, in accordance with an embodiment of the present invention.

FIG. 11*a* is a state table, disclosing the operation of the present invention, where the activation pin oval 78 (as referenced in FIGS. 3 and 4) is disengaged from activation means 98, and, bringing to life the system via the rechargeable battery 20. Activation means 98 in the preferred embodiment is a surface mounted switch that will toggle ON when the pin is removed. The activation is depicted by the arrow flowing from oval 78 to oval 20. It is important to understand that the pin 78 cannot be re-engaged to deactivate the battery powering of the apparatus 10. Referring again to FIGS. 3 and 4, the ribbon 80, physically attached to pin 78 and mostly covering the electrical connection means 12, prevent the apparatus 10 from being installed for its purpose, without first removing the pin 78. And thus, apparatus 10 is always activated via battery 20 before going into service.

Should the battery 20 be low in stored energy, the apparatus 10 will enter a battery low state 212, and issue a 'chirp' signal 214 that will be delivered to the audible alarm oval 32 (as referenced in FIGS. 1*a* and 1*b*). The arrows flowing to and from the battery operation 20 and battery low 212 are indications that this state is constantly monitored via battery monitoring circuit 130 in FIG. 6. The arrow flowing to the chirp oval 214 is an indication that the battery is low.

When the apparatus 10 is installed into service, (such as the Edison socket configuration, electrical connection means 12, being screwed in a lamp—see H-A in FIG. 2*a*), and, the lamp is turned ON, the 230/120 VAC conditioning circuit 14 would enter a line power present state as depicted in oval 14. The system would be now powered via VAC line current as arrows indicate flowing to and from the line power present oval and the battery operating oval 20. Further, the LED's on in the main LED array will illuminate; as depicted by the flow arrow to the main LED array oval 22. The LED's in the main array 22 will stay illuminated as long as there is available 230/120 VAC line power present.

The electronics is active and is monitoring all states of operations as follows. A quiescent state 216 oval is the 'normal' state. If the apparatus 10 is not in a normal quiescent state, it would be in an alarm state by smoke detected and/or carbon monoxide and/or gas detected (ovals 30*a* and 30*b*) or a repeat alarm state 218. The flow arrows to and from said ovals indicate the apparatus 10 being in such states respectively, and would deliver to the alarm state oval 32 that an event occurred and would sound the audible horn. Further, the strobe red LED's 26 and/or strobe amber or blue LED's 27 ovals, are intermittent with strobe white LED's (24 oval).

The red LED's 26 are a visual alarm that smoke is present, while the amber or blue LED's 27 indicates carbon monoxide (blue for gas) was detected. The intermitting of the red or amber or blue with the white LED's 24 strobing, give rise to exactly the type of danger that is present and causing the alarm. As was discussed earlier in FIG. 9 (and will be further detailed in FIG. 13), when VAC line power is available, the strobe white LED's (oval 24) signal the main array 22 to strobe as well; as indicated by the flow arrow between ovals 24 and 22.

The repeat alarm state oval 218, can also activate the alarm state oval 32. This is achieved in one of two ways: 1.) with optional communications circuit 36 (as referenced in FIGS. 1*a* and 1*b*) is present, or 2.) listening via the on board microphone 87/204 (see FIG. 10) for an audible alarm pattern. The audible alarm pattern will be more clearly understood in the waveform disclosed in FIG. 12. Either way, via electronic optional RF communications 36, or, of the listening for an audible alarm pattern, the repeat alarm state on oval 218 will trigger the alarm state 32 and strobe green LED's (green oval 25) intermittent with white strobing LED's (oval 24). The significance of the red and amber or blue strobing LED's or the green strobing LED's are important to understand.

When either the red, amber or blue are strobing, that means extreme danger of the smoke or carbon monoxide or gas was detected local to that apparatus 10, and, when these red or amber or blue visual alarms (LED's 26 and 27) are seen, a user should exit in the opposite direction from the unit being that a high degree of danger is present. The repeat alarm (oval 218) unit, being a second apparatus 10 within either communications or listing range but not physically in smoke or carbon monoxide or gas endowment, gives green strobing LED's 25 to indicate a possible safer exiting route, e.g., sound the audible alarm to give rise to the emergency, and, the green visual strobing indicates that no smoke or carbon monoxide is present at said second repeat alarm location. Should smoke or carbon monoxide or gas migrate to the second apparatus 10 location, the green LED's would turn to red or amber or blue as the case may be as detected by its own on-board detectors 30*a* or 30*b*.

A test alarm 33, mode is entered via oval 33. This is accomplished by turning the apparatus ON/OFF/ON (switch the available 120/230 VAC line power) in quick succession, within one second to activate a test alarm mode. Both the audible and visual alarming means will activate in the test alarm state and will last for five second, or, be silenced via a silence command response via oval 34. Other test patterns can be implemented. For example, to test the network of apparatuses 10, the repeat mode would be carried throughout the structure; to each apparatus 10. When the first alarming unit would stop alarming, each repeat unit would in turn stop the repeat alarm function. In this way, the user could fully test the household system "network" of apparatuses 10.

Figure 11B:
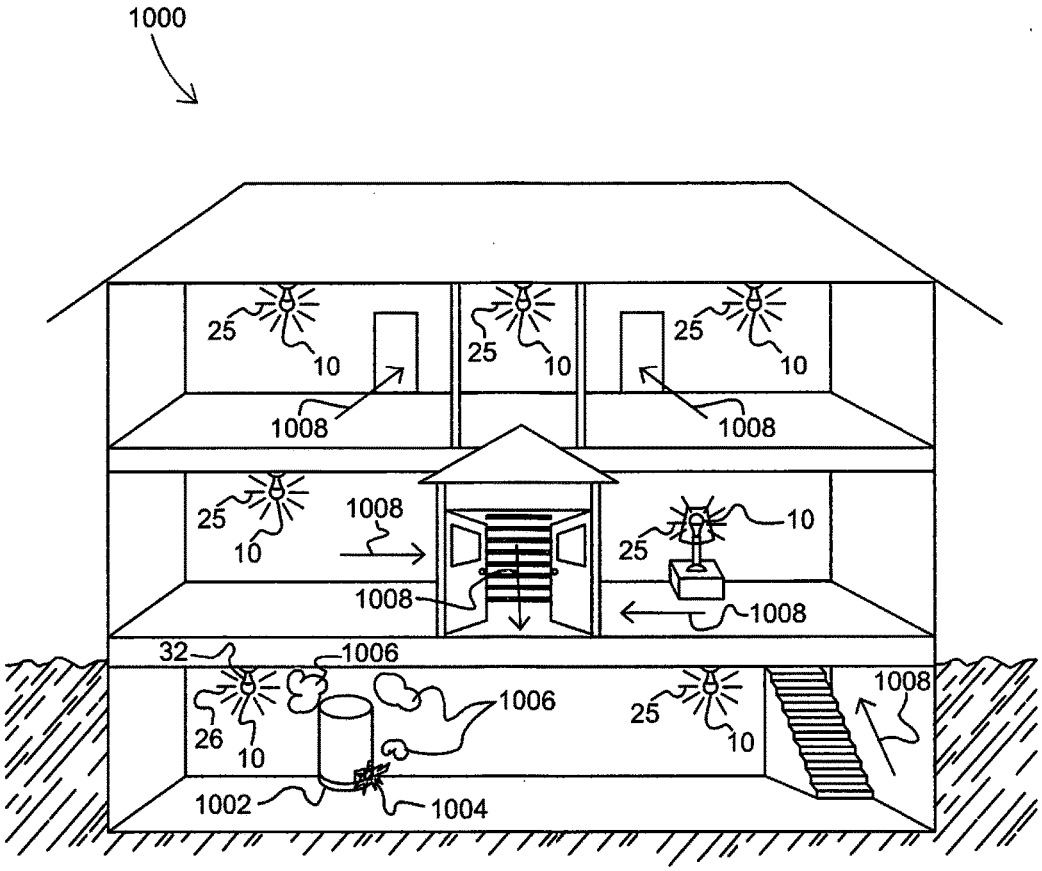
FIG. 11*b* is an illustration on the present patent in a typical home application, in accordance with an embodiment of the present invention.

FIG. 11*b* is an illustration on the present patent 10 in a typical home application 1000. In one possible embodiment, a home application 1000 where, for example, the hot water heater 1002 is on fire 1004 creating smoke 1006. The apparatus 10 nearest the hot water heater is alarming 32, and, strobing RED light 26 (along with audible sound of alarm not shown in FIG. 11*b*). The other apparatuses 10 in the home are strobing GREEN light 25, in a repeat alarm mode. Note the transmission of alarm signals via audible sound and/or IR wireless signals for apparatus 10 to apparatus 10 are not shown but are clearly referenced in other section of this patent. The strobing GREEN 25 lights indicating a safe way out, as represented by arrows 1008, to evacuate the structure to safety.

Thus in this example, when smoke and fire is detected in one area of a home, the lamp will alarm with both strobing red and white light while audibly sounding the siren, giving notice of an immediate danger. And in the upstairs rooms, the repeat alarm functions in green and white strobing light. This gives notice that a danger is nearby, and, indicating a safe exiting route from the home.

Thus for the red LED strobe array 26, smoke and fire detection lamp is in state of emergency is detected, the lamp will alarm with both strobing red and white light while audibly sounding the siren—giving notice of an immediate danger.

For the amber LED strobe array 27, carbon monoxide detection lamp in state of emergency (co) is detected, the lamp will alarm with both strobing amber and white light while audibly sounding the siren. This gives notice of an immediate danger.

For the blue Led strobe array, the gas detection lamp in state of emergency for natural gas, propane, radon, etc. that is detected. The lamp will alarm with both strobing blue and white light while audibly sounding the siren. This gives notice of an immediate danger.

Furthermore, all adjacent apparatuses light up in an emergency if another apparatus is alarming, and in range of its sound (or RF signal if equipped), the lamp will repeat that an alarm was detected, with both strobing green and white light while audibly sounding the siren, giving notice of a danger is nearby. And as discussed above, the white LED main array 22 is a white light for normal state energy, including an efficient LED light.

It is important to understand, in the example shown in FIG. 11*b*, that when the smoke migrates in the structure to other apparatuses 10 in the network alarming in the repeat mode with green and white strobing light (indicating a danger is nearby), said other apparatuses 10 will change to the immediate danger color as is appropriate (strobing red, amber or blue). Thus, updating the network and giving new escape information. That is, always go in the safe direction of green light to escape, and never go in the direction of red, amber or blue light.

Figure 11C:
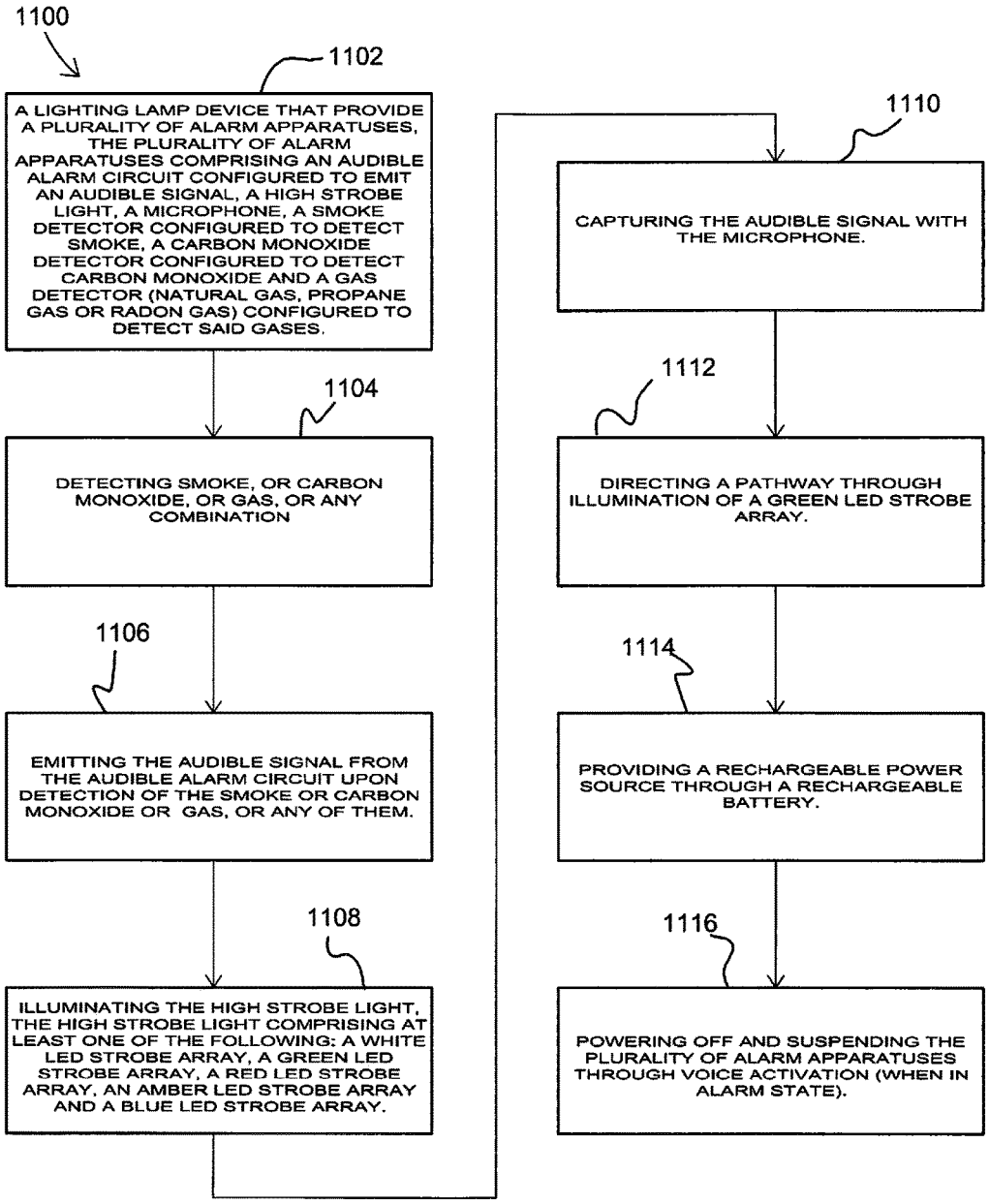
FIG. 11*c* is a flowchart of an exemplary method of synchronized alerting with a networked visual and audible alarm system, in accordance with an embodiment of the present invention.

FIG. 11*c* is a flowchart of an exemplary method 1100 of a lighting lamp device, synchronized alerting with a networked visual and audible alarm system. The method 1100 may include an initial Step 1102 of providing a plurality of alarm apparatuses, the plurality of alarm apparatuses comprising an audible alarm circuit configured to emit an audible signal, a high strobe light, a microphone, a smoke detector configured to detect smoke, and a carbon monoxide detector configured to detect carbon monoxide. Or a gas detector, (so equipped for natural gas, propane gas, radon gas) configured to detect specific gases.

In some embodiments, the method 1100 may further comprise a Step 1104 of detecting smoke, or carbon monoxide, or gas, or any combination. A Step 1106 includes emitting the audible signal from the audible alarm circuit upon detection of the smoke or carbon monoxide, or gas, or any combination. In some embodiments, a Step 1108 comprises illuminating the high strobe light, the high strobe light comprising at least one of the following: a white LED strobe array, a green LED strobe array, a red LED strobe array, an amber LED strobe array, and a blue LED strobe array whereby detection of smoke illuminates the red LED strobe array, whereby detection of carbon monoxide illuminates the amber LED strobe array, whereby detection of gas illuminates the blue LED strobe array, and whereby non-detection illuminates the white LED strobe array.

A Step 1110 may include capturing the audible signal with the microphone, whereby capturing the audible signal without detecting smoke, carbon monoxide or gas illuminates the green LED strobe array. A Step 1112 may include directing a pathway through illumination of the green LED strobe array. A Step 1114 comprises providing a rechargeable power source through a rechargeable battery. A final Step 1116 includes powering off and thus suspending the plurality of alarm apparatuses through voice activation to "SHUT OFF" when in an alarm state if desired.

Figure 12A:
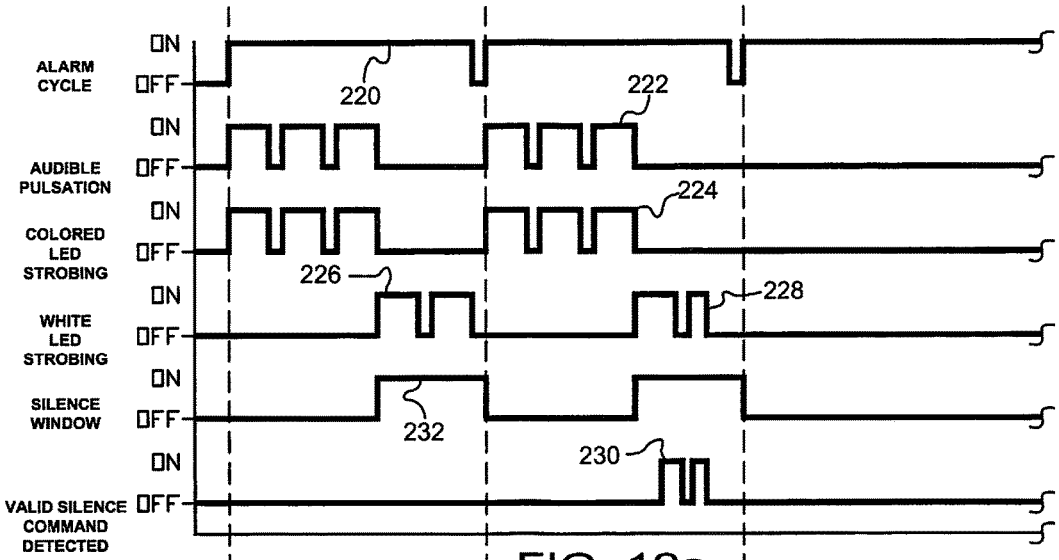
FIG. 12*a*, FIG. 12*b* and FIG. 12*c* all depicts waveforms mapping the various states shown in FIG. 11, and that generated via the circuits of FIGS. 7, 9 and 10, in accordance with an embodiment of the present invention.

Looking now at FIG. 12*a*, where it is shown a waveform mapping a possible results generated from various states of operation in FIGS. 11*a*, 11*b* and 11*c*, there is an alarm cycle waveform 220, an audible pulsation waveform 222, a colored LED strobing waveform 224, a white LED strobing waveform 226, a silence window waveform 232, and a valid silence commend detected waveform 230. Referring to FIG. 11*a*, when entering either the smoke detected or carbon monoxide/gas detected ovals 30*a* or 30*b*, triggers alarm state 32; represented here as 220 waveform.

In the audible pulsation 222 waveform of the horn, there are three pulses (beats) for each alarm cycle 220, as well as four strobing of colored (red 26, or amber or blue 27, or, green 25) LED waveform 224. The alarm cycle 220 also has two strobing white LED waveform 226 of-set with the colored waveform 224. In such a manner, there is an alternating patter to the colored and white LED's arrays 24 and, red 26 or, amber or blue 27 for danger, or, green 25 for repeat mode, as indicated in FIGS. 1*a* and 1*b*.

The silence window waveform 232 shows the interval of time between the horns in the alarm 32 being silenced, so the microphone 87/204 can listen. The valid silence command detected waveform 230 shows that a command to SHUT OFF has been generated and recognized (this function will be discussed in FIG. 12*b*). Note that the audible pulsation 222 and colored and white strobing LED's 224 and 226 have ceased at the exact moment the trailing edge of the second valid silence command detected waveform 230. This moment the alarm turns OFF, time-OFF 228 will suspend the alarm state, for example one minute (as seen in FIG. 11*a*, ovals 32 and 34). If the detected smoke or carbon monoxide or gas has not cleared the detectors 30*a* or 30*b*, then the alarm state will re-establish alarming again as indicated above.

Figure 12B:
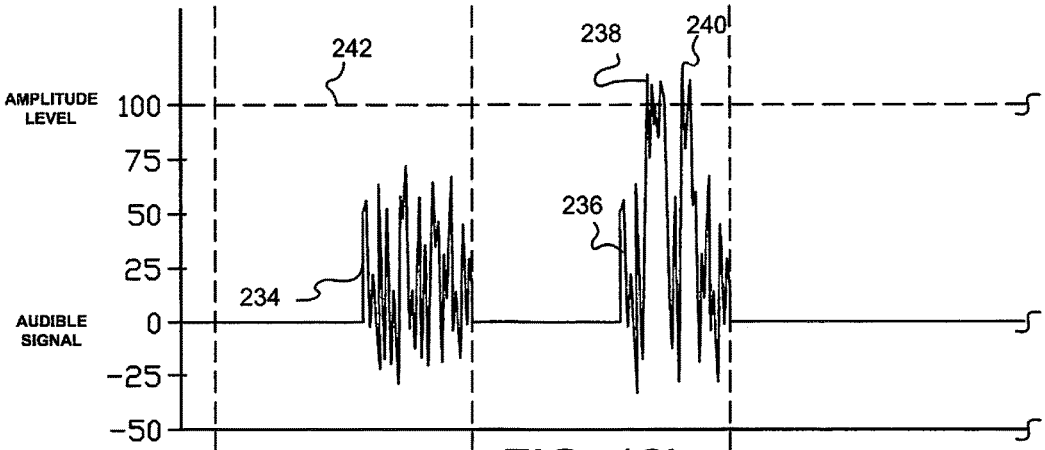

Moving to FIG. 12*b* an audible signal generated within the silence window 232, shows what a spurious noise (background) detected waveform 234 looks like. In the next silence window 232, a possible real command signal waveform 236 shows a first silence recognition waveform 238, and, a second silence recognition waveform 240; both signals being above the required amplitude threshold 242 predetermined amplitude level. Two separate signals, represented as references 238 and 240, must occur within the time that a silence window 232 is open and listening. It is the two distinct signals that form the required 238 and 240 waveforms, that produce the valid silence command detected waveform 230 (via input to amplifier circuit 206 in FIG. 10 meeting required threshold level established by the resistors 210). It should be understood that the user of the present invention of apparatus 10, would verbally command using speech "SHUT OFF" within the listing range of the microphone 87/204.

Further it is understood that any like command having two sharply formed words, such as BE-STILL, QUI-ET, SHUT-UP, etc., or even two 'snapping' of one's fingers sharply could produce the required valid silence signals 238 and 240, resulting in the command pulses 230 to be silent. If there are just one pulse, or if there are three or more pulses, achieving the amplitude threshold 242 level, within a silence window 232 (as determined via counter/divider circuit 208 in FIG. 10 would not output silence signal 200), it would be considered invalid and the alarm would not turn off. These timing waveforms are all generated via the circuits in FIGS. 9 and 10, initiated via the smoke and/or carbon monoxide and/or gas detectors in block 30 of FIGS. 1*a* and 1*b*.

Figure 12C:
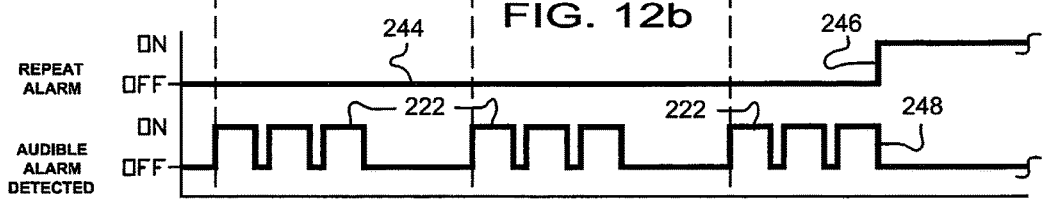

In FIG. 12*c*, it is shown a repeat alarm waveform 244; a time-ON 246 moment alarm is detected waveform, and an audible alarm detected pattern waveform 248. Referring to FIG. 11, the repeat alarm 218 oval constantly listens for the pattern in waveform 248. It accomplishes this by briefly turning ON the microphone 87. Should there be just spurious background noise, like is seen on waveform 234, then the microphone would turn back OFF (saving energy) until the next time to listen is programmed. If there is a sound that has sufficient signal amplitude to meet the threshold 242 predetermined amplitude levels, the microphone 87 would stay ON and listen. If a pattern persists of alarm pulsation waveform 222 three times consecutively, then the apparatus 10 would enter an alarm state 32 at time-ON 248.

The repeat alarm being activated, means that another apparatus 10, within listening range, has alarmed and in an alarm state. The repeat alarm function (referring to FIGS. 9 and 11), would strobe green oval 25 with white oval 24. It is in this way that all such apparatuses 10 can network throughout a structure, such as a home, in just seconds. Further the microphone 87 would continue to listen, in the periods of the silence window 232. If there are no further sounds meeting the threshold amplitude level 242, then the repeat alarm signaling of audible 222 and green strobing 25 alternating with white strobing 24 LED's would automatically stop. As was earlier mentioned, and referring to FIG. 1, if the apparatus 10 is equipped with the manufacturing option of the RF communication circuit 36, then the apparatus 10 would transmit its state and status via RF signaling; and not just rely on the microphone 87/204.

Figure 13A:
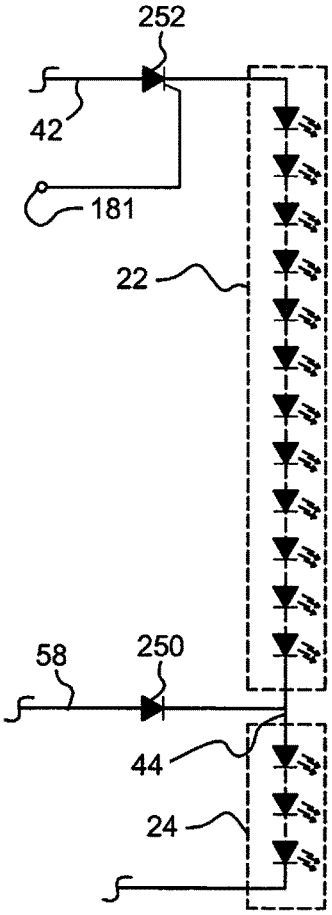
FIG. 13*a* is possible LED array circuit diagram showing Blocks 22 and 24 from FIG. 1 and configured in a serial arrangement layout, in accordance with an embodiment of the present invention.
Figure 13B:
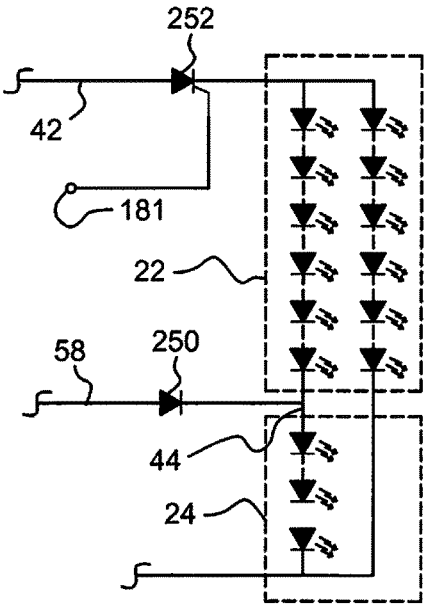
FIG. 13*b* is another possible LED array circuit diagram showing Blocks 22 and 24 from FIG. 1 configured in a serial and parallel arrangement layout, in accordance with an embodiment of the present invention.
Figure 13C:
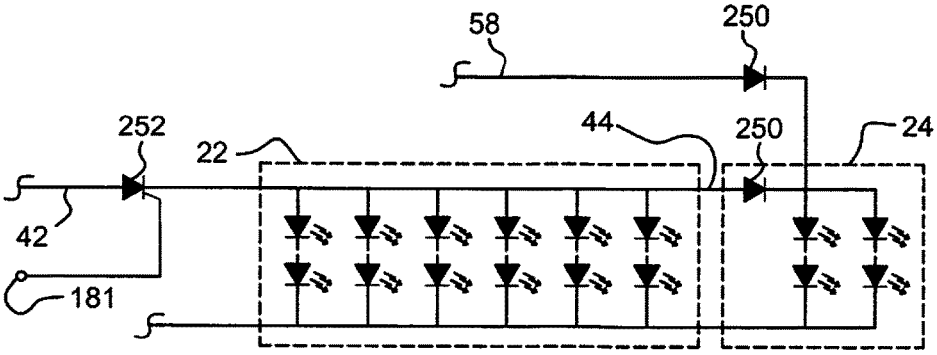
FIG. 13*c* is yet another possible LED array circuit diagram showing Blocks 22 and 24 from FIG. 1 configured in a serial and parallel arrangement layout, in accordance with an embodiment of the present invention.

Finally, in FIG. 13 is shown three conventional layouts of LED arrays. FIG. 13*a* shows a serial arrangement of the main white LED array 22 (referring to FIGS. 1*a* and 1*b*), and, FIG. 13*b* and FIG. 13*c* show a combination of serial and parallel design of main array 22. The white LED's in the strobing LED array 24, in the present invention, have a dual purpose. 1.) when powered by line 42, the array 24 operates as a normal light, e.g., steady ON giving illuminance, and 2.)

used as a strobing white light during an alarm state if on battery power. This is achieved via power provided on line 58.

A steering diode 250 prevents voltages present on line 44 back through the diode 250, thus when power is available on line 42, no other circuits are effected. Likewise, when the strobing power is present on line 58, the LED array 22 is not effected or illuminated; by the unidirectional nature of diodes only allowing current to flow in one direction, isolation between these arrays are achieved. When the apparatus 10 has VAC line power available, and the main array 22 is ON, a silicon controlled rectifier (SCR) 252, would interrupt the steady-state ON of the main array 22.

The effect of the SCR 252, being controlled by the main array strobe signal 181 (as referenced in FIG. 9) would cause the main array 22 to strobe in unison with the white and colored LED arrays as mentioned earlier when the apparatus 10 is in an alarm state. It is important to understand that the main white LED array 22 wills strobe only when VAC line power is available, along with the white strobing array 24, and, the smaller white strobing LED array 24 is only strobing during battery operation; when VAC line power is not available. This conserves energy while still giving a visual alarm during an alarm state.

It is noteworthy to say that the layouts in FIGS. 13*a*, 13*b* and 13*c* are just examples, both in configuration and number of LED's in any of the circuits. There are too many variables in the manufacturing to list them all. Therefore, the inventors explicitly underscore the actual number of LED's used, and their layouts are dependent on the engineer's choice of available LED's, the form of VAC conditioning (as is shown in FIGS. 5*a*, 5*b* and 5*c*), and, the end use of the present invention 10, i.e., the Edison A-19 lamp housing (H-A) in FIG. 2*a*, the recessed housing (H-D) fixture in FIG. 2*d*, the nightlight housing (H-E) in FIG. 2*e*, etc. each of these housing types would use different considerations in the number of LED's, the layout of LED's and the circuit's form as shown in FIGS. 5*a*, 5*b* and 5*c*.

There are many suitable manufactures of both the white and colored LED's, (such as Cree, Lumileds, Osram, Vishay and Avago to name a few) offering hundreds of varieties. Anyone skilled in the art, could select a quantity of LED's and a circuit layout, along with VAC power conditioning that is ideal for any given LED choice; to result in a functioning apparatus 10 of the present invention.

In operation, the present invention for an improved LED light bulb apparatus 10 incorporating a smoke detector means, a carbon monoxide detector means, a gas detector means (any one or all such means) 30, into a bulb envelope housing H-A, H-B, H-C, H-D or H-E, while maintaining substantially the standard style and shape or form of the conventional light bulb housing. The housing, of any style/type/shape of conventional light bulbs, lighting fixtures or lamps; making the improved apparatus 10 disclosed herein, easily a direct replacement for any prior art devices preexisting. Said housings will have partitions 88 and 90, separating areas of the internal spaces. Typically, there are three such spaces; a LED light interior 82, an electronics chamber 84 and a detector/microphone space 86.

The powering circuits can be configured to any particular design need that can use a transformer-less layout as in FIGS. 5*a* and 5*b*, or, the use of step-down transforms as in FIG. 5*c*. The design needs being a consideration for the end use of the present invention in any given application.

The improved LED light bulb apparatus 10 having an audible pulse emissions 222 means, that in an alarm state would pulsate. Such pulsation can be rhythmic, for example 3 beats ON and 1 beat OFF for an alarm cycle 220. This audible pattern is intended to give urgency. Further the audible/visual alarm circuit 32 has high intensity white 24, and, high intensity color (such as RED 26) LED's that strobe alternately ON while in an alarm state 222. Such strobing makes a visible alarm 224 that matches the pulsation of the audible alarming. A 'silencer circuit' 34 would listen (via microphone 87), between the audible pulse emissions (silence window 232). If it hears two sharply structured reverberations 238 and 240, such as in someone shouting the words "SHUT OFF" (or the alike) within a brief window of time 232, the device would suspend the alarm state 228, for example one minute. If the air was not cleared after that period of suspension of time, the alarm would continue. The user could tell it to shut-off again until all air is clear.

The same microphone 87 listening device 204 mentioned above, would listen for audible alarm patterns of sound 222, and if detected three consecutive times (222) in three alarm cycles 220 would repeat the alarm 246; thereby creating a network of two or more like apparatuses 10 of the present invention (like in function, not housing type or style).

In the manufacturing of the apparatus 10, the non-removable, rechargeable battery 20 power is shipped in a dormant state until the end user would cause a 'one-time' activating means 98 (by removing pin 78) to initialize the electronics at instillation. The apparatus' electrical connections 12 are partially cover with ribbon 80, making it impossible to install the device without first removing the pin and ribbon. The rechargeable battery, will keep alive all necessary circuitry during periods when VAC Line power is not available. The battery 20 is always kept at peak capacity when the line voltage is present, and therefore is ready to cover periods when the VAC line voltage is OFF.

Battery operation is restricted via circuitry 66 by selectively powering the apparatus of the present invention while it is in a 'quiescent' state 216. That is, a state where the apparatus is not in an alarm state 32, and therefore can power-down unneeded drains on battery 20. If the battery does experience a drop in stored energy, a low battery is sensed via monitor 130 and would enter a low battery state. Appropriate notification via a pulse to the horn 178 would 'chirp' 214. That is, emit a very short duration pulse of sound, for example once per minute. To correct this low battery situation, the user would simply 'turn-ON' the light apparatus 10 by making the VAC line power present to the system and recharge the battery 20 via circuits in FIG. 6. This would sufficiently re-charge the battery and chirping would immediately stop. It is understood that the microprocessor 28 could better control universally all aspects of operation of the present invention with respect to managing power consumption. Also that an ASIC (Application Specific Integrated Circuit) would greatly help in miniaturization of the electronics, as well as the efficiency of power use.

The present invention for an improved LED light bulb apparatus 10, can communicate 36 via short range signaling, that an alarm was activated. The present unit, detecting the alarm situation via 30, would alternate pulsing of high intensity white and red (or amber or blue) LED's for the visual signal, and the audible pulsation mentioned above. While, any other like (in function) improved LED light bulb 10, within range of the present unit, but not in the smoke or carbon monoxide or gas environment, would repeat alarm (waveform 246) with an audible and visual signaling of its alarm. In this case however would not present the red, amber or blue LED pulsating, but use the green high intensity LED's; until or when it also detected the smoke or carbon monoxide or gas. The green LED's pulsing with the white here would indicate a possible 'safer' escaping route for the user of the apparatus. Thus, such an apparatus 10 would give direction as to possible safer exiting away from the danger. During silence window 232, the repeat apparatus 10 would listen for any sound meeting the amplitude threshold 242, and, if hearing none would stop the repeat alarming both audibly and strobing white and green LED's.

In a scenario of how a home, with the present invention of an improved apparatus 10, is installed in every room may unfold: An user occupant in a center room of a long hallway, with laundry room and garage at one end, and kitchen and living room at the other; is awakened in the middle of the night. With the sound of the detectors blasting from every direction (because of the repeat feature of the apparatuses 10), the occupant opens the door and seeing in the hallway, a 'nightlight' flashing green and white strobing light, would enters the hallway. Looking to the laundry room/garage end direction, sees flashing red and white strobing light. The occupant turning to the other direction, at the kitchen/living room end of the hallway, sees flash green and white strobing light, and would know that a fire (red light) was at the garage end of the house, and would appropriately exit the home in the direction of the green strobing light (safer environment) end. (Or as shown by example in FIG. 11*b*.)

In a case of a 'false' alarm, as would be if something burning on the kitchen stove; and the kitchen apparatus 10 alarms appropriately signal with red and white strobing. The other apparatuses 10 throughout the home soon triggers with a 'repeat', green and white strobing alarm state. The occupant simply would remove the burning pot from the stove (open a window) and verbally command the kitchen apparatus 10 to "SHUT-OFF." The unit immediately stops sounding the alarm (at the recognizing the command); following soon, the other units throughout the home, that are in their repeat state of alarm, would also stop alarming. The suspended alarm state in the kitchen unit would alarm again if the smoke was not cleared.

The apparatus 10 of the present invention takes advantage of all these objectives by directly replacing a conventional light bulb, configured in any conventional style or shape, with an improved LED light bulb incorporating a smoke detector, carbon monoxide detector or gas detector; by having a non-removable rechargeable battery always available and ready to alert in both audible and visual strobing pulsations, and, can be silenced by simply telling it verbally to SHUT OFF; using any two sharply structured reverberations (words/syllables) in a sequence of speech sounds.

The improved device would be configured to all existing lighting lamp configurations, making them easy to replace existing conventional lighting and thus make it easy to up-grade the home or building to a higher level of self-assurance. The disadvantages of prior art listed earlier are all overcome and the user of the present invention can remove older independent smoke and carbon monoxide gas alarming devices that require constant replacing of batteries, and are subject to annoying false triggering of the alarm, that cannot be silenced conveniently, e.g., removing of the its battery. The improved LED light bulb apparatus of the present invention uniquely solves problems that prior art cannot.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A networked visual and audible alarm apparatus, the apparatus comprising:

a housing with LED lighting means;

at least one partition configured to separate sections of internal space with said housing;

an LED light, the LED light comprising at least one of the following: a first color LED strobe array, a second color LED strobe array, a third color LED strobe array, a fourth color LED strobe array, and a fifth color LED array;

a smoke detector configured to detect smoke, the smoke detector disposed within said internal space of said housing;

a carbon monoxide detector configured to detect carbon monoxide, the carbon monoxide detector disposed within said internal space of said housing;

a gas detector configured to detect gas, the gas detector disposed within said internal space of said housing;

an alarm disposed within said internal space of said housing, said alarm having an audible and visual pulsation, said alarm configured to enable testing; wherein said visual pulsation of LED lights is comprised of alternating high intensity LED light of said first color with said LED strobe array of said second color for indicating detection of smoke, and alternating high intensity LED light of said first color with said LED strobe array of said third color for indicating detection of carbon monoxide, and alternating high intensity LED light of said first color with said LED strobe array of said fourth color for indicating detection of gas, and alternating high intensity LED light of said first color with said LED strobe array of said fifth color for a repeat alarm state indicating another apparatus is alarming a danger;

power conditioning of VAC line voltages;

a non-replaceable rechargeable battery, said non-replaceable rechargeable battery having an activation means for actuating said apparatus;

a silence alarm signal active configured to silence said alarm through a verbal command;

a microphone configured to listen for a sound pattern; and a communication portion configured to communicate for purposes of alerting other apparatuses, in a network, to repeat the alarm.

2. The apparatus of claim 1, wherein said housing is configured to directly replace existing prior art lighting housings styles, types and shapes.

3. The apparatus of claim 1, wherein said smoke detector, said carbon monoxide detector, and said gas detector are operatively arranged so that a window of time elapses between audible alarm pulsations to receive audio signals via the microphone, for a command having two generated pulses above a threshold representing said command to shut-off, and suspend alarm state.

4. The apparatus of claim 1, wherein said at least one partition forms a LED light interior, an electronics chamber, and an isolated, detector/microphone/horn space, for smoke, carbon monoxide or gas to enter and exit.

5. The apparatus of claim 1, wherein said audible and visual pulsation, is a rhythmic pattern of lights and sound in three beats ON to one beat OFF.

6. The apparatus of claim 5, wherein said rhythmic pattern of lights and sound is alternating white and green, red, amber, or blue high intensity LED strobes and an audible signal.

7. The apparatus of claim 1, wherein said communication portion is adapted to listen with the on-board microphone, or via transmitting or receiving short range RF signals.

8. A networked visual and audible alarm apparatus, the apparatus comprising:

a housing envelope adapted substantially the standard style and shape of a conventional light bulb housings providing lighting with conventional LED lighting means in a main array;

a plurality of partitions to separate areas of internal space within housing to isolate smoke and gas from LED and electronics;

a power conditioning of VAC line voltages;

a non-replaceable rechargeable battery, said non-replaceable rechargeable battery having an activation pin for initially putting apparatus into service;

an alarm comprising a piezo-electric horn for the audible and strobing LED's for the visual pulsations, and further configured to enable testing the alarm both audible and visual pulsations with sound and LED lights; wherein said visual pulsation of LED lights is comprised of alternating high intensity LED light of said first color with said LED strobe array of said second color for indicating detection of smoke, and alternating high intensity LED light of said first color with said LED strobe array of said third color for indicating detection of carbon monoxide, and alternating high intensity LED light of said first color with said LED strobe array of said fourth color for indicating detection of gas, and alternating high intensity LED light of said first color with said LED strobe array of said fifth color for a repeat alarm state indicating another apparatus is alarming danger;

a silence alarm signal active configured to be powered off through a verbal command;

said a silence alarm signal active having a microphone to listen for sound patterns; and a communication portion configured to communicate for purposes of alerting other apparatuses, in a network, to repeat the alarm state.

9. The apparatus of claim 8, wherein said housing envelop comprises at least one of the following: an Edison A-19 screw base socket, a flood BR-30 screw base socket, a recessed fixture, a track-light fixture, and a nightlight fixture.

10. The apparatus of claim 8, wherein said housing envelop comprising a light-defusing reflector is an electronics casing with vents for detection of smoke, carbon monoxide and gas, a base with electrical connection means, that can be formed to directly replace existing prior art lighting housings of any style, type or shape.

11. The apparatus of claim 8, wherein said housing envelop comprising a light-defusing reflector, an electronics casing with vents, a base with electrical connection means, that can be formed to directly replace existing prior art lighting housing styles, type and shapes and wherein said detection means is a reflective or transmissive photo interrupter means of smoke detection and the carbon monoxide is an ionization detection and the gas is an electro-chemical means, can be for specific gas types and wherein said separate partitioned areas creating a LED light interior space under a light-defusing reflector, a PCB and electronics chamber and an isolated, smoke, carbon monoxide and gas detector area, piezo-electric sounding device, and, microphone space, for allowing smoke and gas to enter/exit isolated detector space, and allowing sound to enter/exit isolated space.

12. The apparatus of claim 8, wherein said audible and visual alarming, is a piercing pulsation of a rhythmic pattern of colored and white lights for visual alarm, and audible sound in three beats ON to one beat OFF, giving rise to any occupants present that danger exists.

13. The apparatus of claim 12, wherein said alternating high intensity LED light of said first color is a white high intensity LED and said LED strobe array of said second color is a red high intensity LED, and said LED strobe array of said third color is an amber high intensity LED, and said LED strobe array of said fourth color is a blue high intensity LED, and said LED strobe array of said fifth color is a green high intensity LED for a repeat alarm state indicating another apparatus is alarming danger.

14. The apparatus of claim 13, further comprising an on-board microphone configured to create waveform pulses consistent with sounds that exceed a predetermined amplitude level representing speech commands, or, other apparatus audibly alarming; or transmitting and receiving via short range RF signals of the same pattern recognition.

15. The apparatus of claim 14, further comprising a smoke detector, a carbon monoxide detector, and a gas detector, the detectors configured to utilize a threshold measuring process and wherein said separate partitioned areas have interior space under a light-defusing reflector, PCB and electronics chamber and an isolated, smoke, carbon monoxide and gas detector area, with piezo-electric sounding device, and, microphone, disposed near vents for allowing smoke and gas to enter/exit isolated space, and allowing sound to enter/exit isolated space.

16. The apparatus of claim 13, wherein said audible and visual alarming is a piercing pulsation of a rhythmic pattern of colored, LED, and, white light LED, with sound in three beats ON to one beat OFF in waveform, giving rise to any occupants present that danger exists.

17. The apparatus of claim 16, wherein said rhythmic pattern of lights and sound is alternating white high intensity LED with red high intensity LED for smoke, alternating white high intensity LED with amber or blue high intensity LED for carbon monoxide or gas respectively, and, alternating white high intensity LED with green high intensity LED for a 'repeat' state indicating another apparatus was alarming a danger, and along with an audible piezo-electrical horn, creating a light and sound pattern, that give a sense of urgency.

18. The apparatus of claim 17, wherein said communication means is an on-board microphone and means to create waveform pulses consistent with sounds that exceed a predetermined amplitude level and representing speech commands that produce valid silence first and second recognition waveforms generating the stop alarming pulses, valid silence command, or, other apparatus audibly alarming; or transmitting/receiving via short range RF signals of the same pattern recognition.

19. The apparatus of claim 18, wherein said audible and visual alarming is to include a test alarm means, by turn the apparatus ON/OFF/ON in quick succession, within one second to activate a test mode wherein said test mode alarm state will last for five second and repeated to all like apparatuses in a network, or, be silenced via a silence command response.

20. A method of synchronized alerting with a networked visual and audible alarm apparatus, the method comprising:

providing lighting with conventional LED lighting means in a main array, when not in an alarm state, providing a communications means either by sound and RF signaling between like units within range in network, providing a plurality of alarm apparatuses, the plurality of alarm apparatuses comprising an audible alarm circuit configured to emit an audible signal, a high strobe light, a microphone, a smoke detector configured to detect smoke, and a carbon monoxide detector configured to detect carbon monoxide;

detecting smoke, carbon monoxide, or gas, and any combination of all three;

emitting the audible signal from the audible alarm circuit upon detection of the smoke, carbon monoxide or the gas, or gas, and any combination of all three;

illuminating the high strobe light, the high strobe light comprising at least one of the following: a white LED strobe array, a green LED strobe array, a red LED strobe array, an amber LED strobe array, and a blue LED strobing array, whereby detection of smoke illuminates the red LED strobe array, whereby detection of carbon monoxide illuminates the amber LED strobe array, whereby detection of gas (natural gas, propane gas or redon gas) illuminates the blue LED strobe array, whereby non-detection illuminates the white LED strobe array;

capturing the audible signal with the microphone, whereby capturing the audible signal without detecting smoke or carbon monoxide or gas illuminates the green LED strobe array;

directing a pathway through illumination of the green LED strobe array;

providing a rechargeable power source through a rechargeable battery; and powering off the plurality of alarm apparatuses through voice activation to shut off alarm.

* * * * *